US005258352A

United States Patent [19]

Fujimura et al.

[11] Patent Number: 5,258,352

[45] Date of Patent: Nov. 2, 1993

[54] HEAT TRANSFER RECORDING MEDIUM AND HEAT TRANSFER RECORDING METHOD

[75] Inventors: Hideo Fujimura; Masanori Torii, both of Tokyo, Japan

[73] Assignee: Dai Nippon Insatsu Kabushiki Kaisha, Tokyo, Japan

[21] Appl. No.: 715,091

[22] Filed: Jun. 10, 1991

[30] Foreign Application Priority Data

| | | | |
|---|---|---|---|
| Jun. 9, 1990 | [JP] | Japan | 2-150574 |
| Aug. 24, 1990 | [JP] | Japan | 2-221181 |
| Aug. 24, 1990 | [JP] | Japan | 2-221182 |
| Aug. 24, 1990 | [JP] | Japan | 2-221183 |
| Aug. 24, 1990 | [JP] | Japan | 2-221184 |
| Aug. 24, 1990 | [JP] | Japan | 2-221185 |
| Mar. 26, 1991 | [JP] | Japan | 3-084426 |
| Mar. 26, 1991 | [JP] | Japan | 3-084427 |
| Mar. 26, 1991 | [JP] | Japan | 3-084428 |
| Mar. 26, 1991 | [JP] | Japan | 3-084429 |
| Mar. 26, 1991 | [JP] | Japan | 3-084430 |

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS

| | | | |
|---|---|---|---|
| 4,294,641 | 10/1981 | Reed et al. | 156/234 |
| 4,871,715 | 10/1989 | Harrison et al. | 503/227 |
| 4,876,236 | 10/1989 | Vanier et al. | 503/227 |
| 4,876,238 | 10/1989 | Vanier et al. | 503/227 |

FOREIGN PATENT DOCUMENTS

| | | | |
|---|---|---|---|
| 60-19590 | 1/1985 | Japan | 503/227 |
| 62-124982 | 6/1987 | Japan | 503/227 |
| 62-132676 | 6/1987 | Japan | 503/227 |
| 63-264397 | 11/1988 | Japan | 503/227 |
| 63-268691 | 11/1988 | Japan | 503/227 |
| 63-288790 | 11/1988 | Japan | 503/227 |
| 1-113275 | 5/1989 | Japan | 503/227 |
| 2-252581 | 10/1990 | Japan | 503/227 |

*Primary Examiner*—B. Hamilton Hess

*Attorney, Agent, or Firm*—Wegner, Cantor, Mueller & Player

[57] ABSTRACT

A heat transfer recording medium usable for producing an image by employing thermal printing means such as a thermal head, in which a dye layer of a heat transfer sheet or a dye-receiving layer of a heat transfer image-receiving sheet comprises therein or thereon a dye-transfer promoting agent comprising a compound which is in a crystalline state at room temperature and can be fused by thermal energy which is applied when heat transfer recording is conducted.

A heat transfer recording method using a heat transfer sheet and an image-receiving sheet, in which a dye-transfer promoting agent comprising a compound which is in a crystalline state at room temperature and can be fused by thermal energy which is applied when heat transfer recording is conducted is given to a dye layer and/or a dye-receiving layer before the formation of an image.

8 Claims, 2 Drawing Sheets

HEAT TRANSFER RECORDING MEDIUM AND HEAT TRANSFER RECORDING METHOD

BACKGROUND OF THE INVENTION

This invention relates to a heat transfer recording medium. More particularly, this invention concerns to a heat transfer recording medium and a heat transfer recording method which are effectively employable in a heat transfer recording process utilizing a sublimable dye (heat-transferable dye), can impart high transferability to the dye when heat transfer recording is conducted, and can produce an image which is excellent in density.

Conventional recording and printing methods are now being replaced by newly developed methods such as an ink-jet printing method and a heat transfer recording method, which can simply produce a mono- or full-colored image at high speed. Of these methods, the most excellent one is a so-called sublimation-type heat transfer recording method utilizing a sublimable dye, which can produce a full-colored image having an excellent continuous gradation, comparable to a photographically obtainable color image.

A heat transfer sheet commonly used with the above-mentioned sublimation-type heat transfer recording method is such that a dye layer containing a sublimable dye and a binder is formed on one surface of a substrate film such as a polyester film, and on the other surface of the substrate film is formed a heat resistive layer which protects adhesion between the heat transfer sheet and a thermal head.

The heat transfer sheet is superposed on an image-receiving sheet having an image-receiving layer comprising a polyester resin or the like so that the dye layer of the heat transfer sheet and the image-receiving layer of the image-receiving sheet can face each other. Thermal energy is then applied imagewise to the back surface of the heat transfer sheet by a thermal head, whereby the dye contained in the dye layer is transferred to the image-receiving sheet. A desired image can thus be successfully produced in the image-receiving sheet.

In the above heat transfer recording process, only the dye contained in the dye layer is transferred to the image-receiving sheet, and the binder remains on the surface of the substrate film of the heat transfer recording sheet. A high-density image can be sharply produced when transferability of the dye is high.

The simplest method to enhance transferability of the dye is to apply a large amount of printing energy when conducting printing. It is, however, clear that the application of a large amount of printing energy requires high printing cost, so that such a method is undesirable. In addition, when a plastic film is used as a substrate film of the heat transfer sheet, there is a limitation on the amount of printing energy applicable to the recording sheet.

The use of a dye having a low molecular weight is another well known method for improving the dye-transferability. However, an image produced by using such a dye is suffered from the problem of low fastness; in other words, the image has low bleed and heat resistances.

To eliminate the above problem, a dye having a high molecular weight has been used. However, this is not a good solution, because such a dye has low transferability and cannot provide a sharp and high-density image.

Accordingly, an object of the present invention is to provide a heat transfer recording medium and a heat transfer recording method, which can produce an image having a sufficiently high density with application of printing energy in a smaller amount than that of printing energy required in the conventional recording methods, and can produce an image having a density higher than the above with application of printing energy in the same amount as applied in the conventional recording methods.

SUMMARY OF THE INVENTION

The above object can be attained by the present invention described below.

The present invention firstly provides a heat transfer sheet comprising a substrate film, and a dye layer formed thereon, which comprises a dye, a binder, and a dye-transfer promoting agent comprising a compound which is in a crystalline state at room temperature and can be fused by thermal energy which is applied when heat transfer recording is conducted, preferably a compound having the following formula (I):

$$A\text{-}[B\text{-}X\text{-}Y\text{-}Z]_2 \qquad (I)$$

wherein A is selected from the group consisting of

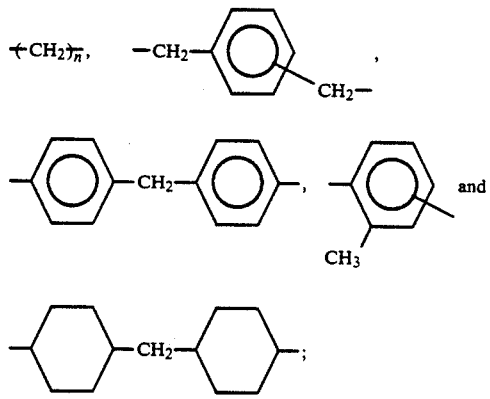

n is an integer of 1 or more; B is selected from the group consisting of —NHCOO—, —NHCONR—, —CONH— and —NHCO—; R is a linear or branched $C_1$–$C_6$ alkyl group which may have a substituent; X is a linear or branched alkylene group which may have a substituent; Y is a single bond, or a bonding group selected from the group consisting of —O—, —S—, —COO—, —OOC—, —NHCOO—, —OOCHN—, —CONH—, —NHCO—, —$SO_2$NH—, —NH$SO_2$—, —$SO_2$— and —$O_2$S—; and Z is a hydrogen atom, a linear or branched alkyl group which may have a substituent and/or an unsaturated group, or a phenyl group.

By incorporating the compound having the above formula (I) into a dye layer, there can be provided a heat transfer sheet which can produce an image having a sufficiently high density with application of printing energy in a smaller amount than that of printing energy required in the conventional recording methods, and can produce an image having a density higher than the above with application of printing energy in the same amount as applied in the conventional recording methods.

The present invention secondly provides a heat transfer sheet comprising a substrate film, a dye layer formed on the substrate film, comprising a dye and a binder, and a dye-transfer promoting layer formed on the dye layer, comprising a compound which can be fused by thermal energy which is applied when heat transfer recording is conducted, preferably a compound having the above formula (I).

When heat transfer recording is conducted by using a heat transfer sheet whose dye layer is provided with a dye-transfer promoting layer comprising a compound which has a low melting point and can be fused by thermal energy which is applied when heat transfer recording is conducted, space between the dye layer and a dye-receiving layer can be eliminated. Therefore, heat applied by a thermal head can be quickly diffused to the dye-receiving layer, and the layer can be effectively heated. In addition, the fused dye-transfer promoting layer also serves as a solvent of the dye, so that transfer of the dye is further promoted.

The present invention thirdly provides a heat transfer sheet comprising a substrate film, a dye layer formed on the substrate film, comprising a dye and a binder, and a dye-transfer promoting layer formed on the substrate film, next to the dye layer, comprising a compound which can be fused by thermal energy which is applied when heat transfer recording is conducted, preferably a compound having the above formula (I).

When the dye-transfer promoting layer, formed on the substrate film, comprising a compound which has a low melting point and can be fused by thermal energy which is applied when heat transfer recording is conducted is thermally transferred to a dye-receiving layer of a heat transfer image-receiving sheet before or upon conducting heat transfer recording, and then the dye is transferred thereto from the dye layer, space between the dye layer and the dye-receiving layer is eliminated. For this reason, heat applied by a thermal head can be quickly diffused to the dye-receiving layer, and the layer can be effectively heated. In addition, the fused dye-transfer promoting layer also serves as a solvent of the dye, so that transfer of the dye is further promoted.

The present invention fourthly provides a heat transfer image-receiving sheet comprising a substrate film, a dye-receiving layer formed on at least one surface of the substrate film, and a dye-transfer promoting layer formed on the dye-receiving layer, comprising a compound having the above formula (I).

When heat transfer recording is conducted by using the heat transfer image-receiving sheet of which dye-receiving layer is provided with the dye-transfer promoting layer comprising a compound which has a low melting point and can be fused by thermal energy which is applied when heat transfer recording is conducted, space between a dye layer and the dye-receiving layer is eliminated. Therefore, heat applied by a thermal head quickly diffuses to the dye-receiving layer, and the layer is effectively heated. In addition, the fused dye-transfer promoting layer also serves as a solvent of the dye, so that transfer of the dye is further promoted.

Moreover, since transfer of the dye is promoted due to the above-described reason, a resin having a high glass transition temperature is usable for forming the dye-receiving layer. When such a resin is used, the problem of abnormal transfer recording can be eliminated. In addition, the dye transferred to the dye-receiving layer is prevented from blurring, so that an image produced in the heat transfer image-receiving sheet exhibits high preservability.

The present invention fifthly provides a heat transfer image-receiving sheet comprising a substrate film, and a dye-receiving layer formed on at least one surface of the substrate film, which comprises a dye-transfer promoting agent comprising a compound which can be fused by thermal energy which is applied when heat transfer recording is conducted, preferably a compound having the above formula (I). The preferred embodiment of this invention is a heat transfer image-receiving sheet comprising (i) a substrate film, (ii) a dye-receiving layer formed at least one surface of the substrate film, comprising a thermoplastic resin containing 0.1 to 8 wt. % of nitrogen atom, and a compound which can be fused by thermal energy which is applied when heat transfer recording is conducted, preferably a compound having the above formula (I), and (iii) a releasing layer formed on the surface of the dye-receiving layer, comprising a catalyst-setting-type releasing agent containing an unsaturated bond.

In the above embodiment of the invention, the catalyst-setting-type releasing agent containing an unsaturated bond is incorporated into the dye-receiving layer which comprises the specific resin and the dye-transfer promoting agent. Therefore, there can be provided the heat transfer image-receiving sheet which is excellent in releasability, printing sensitivity and preservability.

The present invention sixthly provides a heat transfer recording method comprising the steps of superposing a heat transfer sheet comprising a substrate film, and a dye layer formed thereon, which comprises a dye and a binder on a heat transfer image-receiving sheet comprising a dye-receiving layer, and applying thermal energy imagewise from the back surface of the heat transfer recording sheet to produce an image on the dye-receiving layer, characterized in that a dye-transfer promoting agent which can be fused by thermal energy which is applied when heat transfer recording is conducted is given to the dye layer and/or the dye-receiving layer before the formation of the image.

When the dye-transfer promoting agent is given to the surface of the dye layer of the heat transfer sheet and/or that of the dye-receiving layer of the heat transfer image-receiving sheet before or upon conducting heat transfer recording, and the dye is then transferred thereto from the dye layer, space between the dye layer and the dye-receiving layer is eliminated. For this reason, heat applied by a thermal head can be quickly diffused to the dye-receiving layer, and the layer is effectively heated. In addition, the fused dye-transfer promoting agent also serves as a solvent of the dye. Transfer of the dye is thus further )promoted.

DETAILED DESCRIPTION OF THE PREFERRED EMBODIMENTS

Dye-Transfer Promoting Agent

Figure 1:
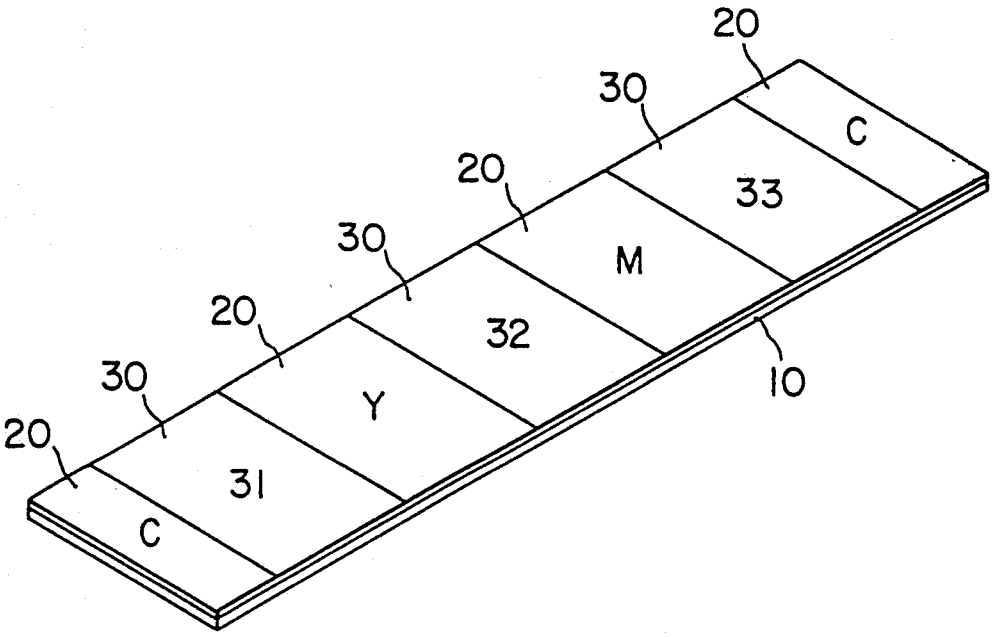
FIG. 1 and FIG. 2 are perspective views of the embodiments of the heat transfer sheets according to the present invention.

In the present invention, a compound which can be fused by thermal energy which is applied when heat transfer recording is conducted, preferably a compound having a low melting point of 50 to 150° C., preferably 60 to 130° C., is used as the dye-transfer promoting agent, or is incorporated into the dye-transfer promoting layer. A compound having a melting point of less than 50° C. is also usable, but handling of such a compound is not good because it is sticky and tends to cause blocking. On the other hand, a compound having a melting point of higher than 150° C. brings about drastic deterioration of the dye-transfer promoting effect.

It is preferable that the molecular weight of the compound having a low melting point for use in the present invention be in the range of from 100 to 1,500. When the molecular weight is less than 100, the melting point of the compound cannot be 50° C. or higher. On the other hand, when the molecular weight is more than 1,500, the compound cannot be fused sharply when heat transfer recording is conducted, so that dye-transfer promoting effect cannot be satisfactorily obtained.

A compound represented by the following formula (I) fulfills the above-described requirements, and is preferably employed in the present invention as the compound having a low melting point:

$$A\text{-}[B\text{-}X\text{-}Y\text{-}Z]_2 \qquad (I)$$

wherein A is selected from the group consisting of

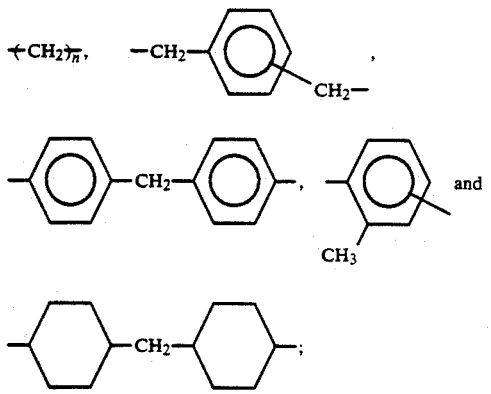

n is an integer of 1 or more; B is selected from the group consisting of —NHCOO—, —NHCONR—, —CONH— and —NHCO—; R is a linear or branched $C_1$-$C_6$ alkyl group which may have a substituent; X is a linear or branched alkylene group which may have a substituent; Y is a single bond, or a bonding group selected from the group consisting of —O—, —S—, —COO—, —OOC—, —NHCOO—, —OOCHN—, —CONH—, —NHCO—, —$SO_2$NH—, —NH$SO_2$—, —$SO_2$— and —$O_2$S—; and Z is a hydrogen atom, a linear or branched alkyl group which may have a substituent and/or an unsaturated group, or a phenyl group.

The compound having the above formula (I) can be prepared by one of the following methods: (1) a method in which a diisocyanate compound is reacted with an alcohol having the formula HO—X—Y—Z or with a nitrogen-substituted amine having the formula HN(R)—X—Y—Z; (2) a method in which a dicarboxylic acid compound is reacted with an amine having the formula $H_2N$—X—Y—Z; and (3) a method in which a diamine compound is reacted with a carboxylic acid having the formula HOOC—X—Y—Z. In the above formulae, R, X, Y and Z have the same meanings as defined in the above formula (I).

Of these compounds (I), the following compounds are particularly preferred.

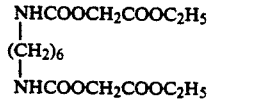

Compound 1

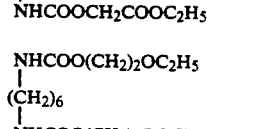

Compound 2

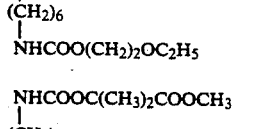

Compound 3

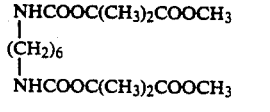

Compound 4

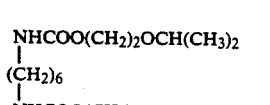

Compound 5

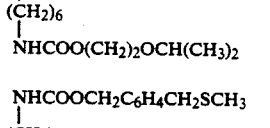

Compound 6

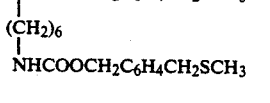

Compound 7

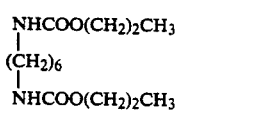

Compound 8

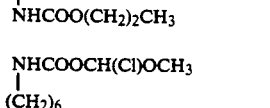

Compound 9

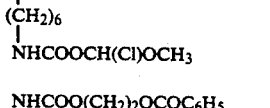

Compound 10

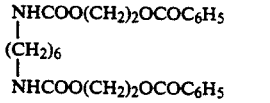

Compound 11

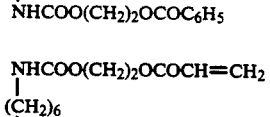

Compound 12

-continued

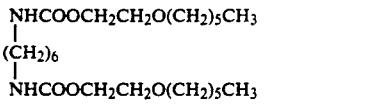

Compound 13

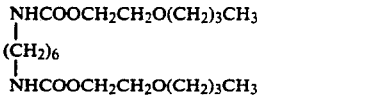

Compound 14

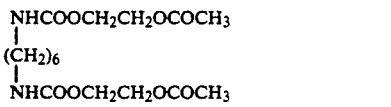

Compound 15

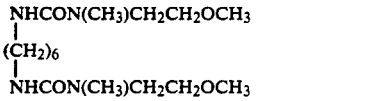

Compound 16

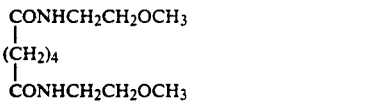

Compound 17

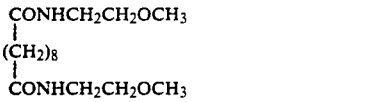

Compound 18

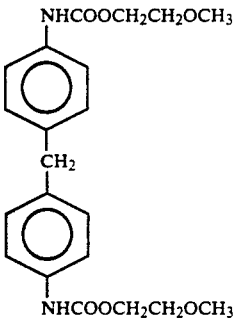

Compound 19

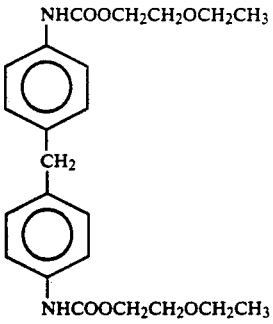

Compound 20

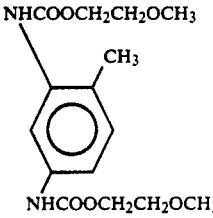

Compound 21

-continued

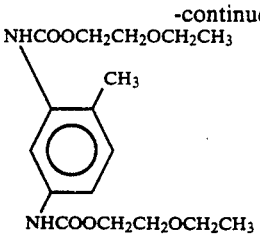

Compound 22

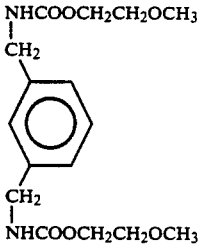

Compound 23

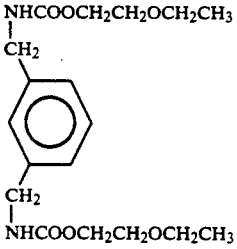

Compound 24

Heat Transfer Sheet (1)

The heat transfer sheet according to the present invention is prepared in basically the same manner as in the prior art; namely, a dye layer is formed on a substrate film. The heat transfer sheet of the invention is, however, characterized in that a dye-transfer promoting agent preferably comprising the compound having the above formula (I) is incorporated into the dye layer.

Any known material having, in some degree, heat resistance and mechanical strength is employable as the substrate film of the heat transfer sheet of the present invention. For instance, paper, processed paper of various types, a polyester film, a polystyrene film, a polypropylene film, a polysulfone film, an aramide film, a polycarbonate film, a polyvinyl alcohol film, cellophane paper, and the like can be used as the substrate film. Of these, a polyester film is particularly preferable. The thickness of the substrate film is from 0.5 to 50 μm, preferably from 3 to 10 μm. No particular limitation is imposed on the form of the substrate film, and the above substrate films can be used either in sheet form or as a continuous film. The dye layer formed on the surface of the above substrate film is a layer in which at least a dye and the compound having formula (I) are supported by a binder resin.

No particular limitation is imposed on the dye for use in the present invention, and any dye which has been used for conventionally known heat transfer sheets is usable in the present invention. Examples of the dye preferably usable in the invention include MS Red G, Macrolex Red Violet R, Ceres Red 7B, Samaron Red HBSL and Resolin Red F3BS as red dyes; Phorone Brilliant Yellow 6GL, PTY-52 and Macrolex Yellow 6G as yellow dyes; and Kayaset Blue 714, Waxoline Blue AP-FW, Phorone Brilliant Blue S—R and MS Blue 100 as blue dyes.

Any conventionally known binder resin is usable as the binder resin in the present invention to support the above-described dye. Preferred examples of the binder resin include cellulose resins such as ethyl cellulose, hydroxyethyl cellulose, ethylhydroxy cellulose, hydroxypropyl cellulose, methyl cellulose, cellulose acetate and cellulose acetate butyrate, vinyl resins such as polyvinyl alcohol, polyvinyl acetate, polyvinyl butyral, polyvinyl acetal, polyvinyl pyrrolidone and polyacryl amide, and polyester resins. Of these resins, cellulose resins, acetal resins, butyral resins and polyester resins are preferable from the viewpoints of heat resistance and transferability of dye.

In the present invention, the dye-transfer promoting agent which is preferably incorporated into the dye layer is a compound having the formula (I). Preferred examples of the agent are the same as the above-enumerated Compounds 1 to 24.

The amount of the dye-transfer promoting agent is preferably from 5 to 150 parts by weight per 100 parts by weight of the binder contained in the dye layer. In the case where the amount of the agent is less than 5 parts by weight, improvement in transferability of the dye cannot be satisfactorily attained. On the other hand, when the amount of the agent is more than 150 parts by weight, the dye layer tends to cause separation and blocking.

Furthermore, it is preferable that the dye-transfer promoting agent be existing in the dye layer in the dissolved state. The dissolved state herein includes the molecular dispersion state. The dye-transfer promoting agent for use in the present invention is, in general, excellent in solubility. In the case where compatibility between the binder and the dye-transfer promoting agent contained in the dye layer is not high, the dye-transfer promoting agent tends to bleed out the dye layer, or to bloom thereon during the preservation, resulting in decay of the dye layer.

Conventionally known various additives can also be incorporated into the dye layer, if necessary.

The dye layer is formed on the substrate film preferably in the following method:

The above-described sublimable dye and binder resin, and auxiliary components such as a releasing agent are dissolved or dispersed in a proper solvent. A coating composition or ink for forming a dye layer thus obtained is coated onto the surface of the above-described substrate film, and then dried to form the dye layer.

The thickness of the dye layer is approximately from 0.2 to 5.0 μm, preferably from 0.4 to 2.0 μm. The amount of the sublimable dye contained in the dye layer is from 5 to 90 wt. %, preferably from 10 to 70 wt. %, of the total weight of the dye layer.

To produce a monochromic image, the dye layer is prepared by using a dye of a predetermined color, selected from the above-mentioned dyes. To produce a full-colored image, it is necessary to respectively prepare dye layers of yellow, magenta, cyan, and, if necessary, black colors by using dyes of yellow, magenta, cyan, and, if necessary, black which are properly selected from the above-mentioned dyes.

To conduct image recording, any heat transfer image-receiving sheet whose recording surface is receptive to the above dyes can be used in combination with the above heat transfer recording sheet of the present invention. Even those materials which are not receptive to the dyes, such as paper, metals, glass and synthetic resins can be used as heat transfer image-receiving materials if they are provided with a dye-receiving layer on at least one surface of sheets or films of the above materials.

The following materials can be used as a heat transfer image-receiving sheet without being provided with a dye-receiving layer: for instance, fibers, woven cloths, films, sheets, and processed materials made from polyolefin resins such as polypropylene, halogenated polymers such as polyvinyl chloride and polyvinylidene chloride, vinyl polymers such as polyvinyl acetate and polyacrylate, polyesterresins such as polyethyleneterephthalate and polybutyleneterephthalate, polystyrene resins, polyamide resins, copolymer resins of an olefin such as ethylene or propylene and a vinyl monomer, ionomers, cellulose resins such as cellulose diacetate, and polycarbonate. Of these, a sheet or film of polyester, and processed paper provided with a polyester layer are particularly preferred.

Further, even those materials such as paper, metals and glass which are not receptive to the dyes can be used as a heat transfer image-receiving sheet. In this case, a solution or dispersion of the above-described resin which is receptive to the dyes is coated onto the recording surface of the above material, or a film of the resin is laminated thereon to form a dye-receiving layer. In addition, a dye-receiving layer may be formed even on the above-described dye-receptive material by using the resin having high dye-receptivity in the same manner as in the above.

The dye-receiving layer may be formed by using the above materials either singly or in combination. It is needless to say that various additives can be incorporated into the dye-receiving layer as long as they do not disturb the accomplishment of the purposes of the invention.

There is no particular limitation on the thickness of the dye-receiving layer; however, it is generally from 3 to 50 μm. It is preferable that the dye-receiving layer be in a continuous film. However, a non-continuous film formed by using a resin emulsion or a resin dispersion is also acceptable.

Any conventional means for applying thermal energy is employable when conducting heat transfer recording by using the above heat transfer sheet according to the present invention and the above heat transfer image-receiving sheet in combination. For instance, recording apparatus such as a thermal printer, "Video Printer VY-100" (Trademark) manufactured by Hitachi Co., Ltd., are usable for the purpose. A desired image can be satisfactorily obtained by applying thermal energy, which is controllable by changing the printing time, in an amount of approximately from 5 to 100 $mJ/mm^2$ by the thermal printer to the heat transfer sheet.

Heat Transfer Sheet (2)

The heat transfer sheet according to the present invention is prepared in basically the same manner as in the prior art; namely, a dye layer is formed on a substrate film. The heat transfer sheet of the invention is, however, characterized in that a dye-transfer promoting layer comprising a compound which can be fused by thermal energy which is applied when heat transfer recording is conducted, preferably a compound having the above formula (I), is formed on the dye layer.

The substrate films, dyes and binders mentioned in the heat transfer sheet (1) are all usable in this heat transfer sheet.

Further, conventionally known various additives such as a releasing agent and an ultraviolet absorbing agent can be incorporated into the dye layer, if necessary.

The dye layer is formed on the substrate film preferably in the following method:

The above-described sublimable dye and binder resin, and other auxiliary components are dissolved or dispersed in a proper solvent. A coating composition or ink for forming a dye layer thus obtained is coated onto the surface of the above-described substrate film, and then dried to form the dye layer.

The thickness of the dye layer is approximately from 0.2 to 5.0 μm, preferably from 0.4 to 2.0 μm. The amount of the sublimable dye contained in the dye layer is from 5 to 90 wt. %, preferably from 10 to 70 wt. %, of the total weight of the dye layer.

To produce a monochromic image, the dye layer is prepared by using a dye of a predetermined color, selected from the previously-mentioned dyes. To produce a full-colored image, it is necessary to respectively prepare dye layers of yellow, magenta, cyan, and, if necessary, black colors by using dyes of yellow, magenta, cyan, and, if necessary, black which are properly selected from the previously-mentioned dyes.

In the present invention, a dye-transfer promoting layer is formed on the surface of the above-described dye layer. A material preferably used for forming the dye-transfer promoting layer is a compound having the formula (I), and the preferred examples of the material are the same as the previously-enumerated Compounds 1 to 24.

The dye-transfer promoting layer comprising the above compound can be formed in the following manner:

Namely, the compound is dissolved or dispersed in an organic solvent to give a solution or dispersion having a low concentration of the compound. The solution or dispersion is coated onto the surface of the dye layer by a known method, and the solvent is then removed by evaporation to form the dye-transfer promoting layer. It is not necessary that the dye-transfer promoting layer be in a continuous complete film. The layer can exist non-continuously in the state of particles, as long as it is fused at a temperature elevated by heating when heat transfer recording is conducted, and forms a liquid phase. The thickness of the dye-transfer promoting layer is preferably from 0.01 to 1.0 g/m$^2$ when expressed in the coating amount. When the coating amount is less than the above range, the dye-transfer promoting effect cannot be satisfactorily obtained, while when it is in excess of the above range, the effect is reduced.

When forming the dye-transfer promoting layer, various binders and releasing agents such as described in the heat-transfer recording sheet (1) can be employed together with the compound having a low melting point as long as they do not disturb the accomplishment of the purposes of the present invention. Furthermore, various additives such as an ultraviolet absorbing agent and an antioxidant can also be incorporated into the dye-transfer promoting layer.

To conduct image recording, any heat transfer image-receiving sheet whose recording surface is receptive to the above dyes can be used in combination with the above heat transfer sheet of the present invention. Even those materials which are not receptive to the dyes, such as paper, metals, glass and synthetic resins can be used as heat transfer image-receiving sheets if they are provided with a dye-receiving layer on at least one surface of sheets or films of the above materials.

Any conventional means for applying thermal energy is employable when conducting heat transfer recording by using the above heat transfer sheet of the present invention and the above heat transfer image-receiving sheet in combination. For instance, recording apparatus such as a thermal printer, "Video Printer VY-100"(Trademark) manufactured by Hitachi Co., Ltd., are usable for the purpose. A desired image can be satisfactorily obtained by applying thermal energy, which is controllable by changing the printing time, in an amount of approximately from 5 to 100 mJ/mm$^2$ by the thermal printer to the heat transfer sheet.

Heat Transfer Sheet (3)

Figure 2:
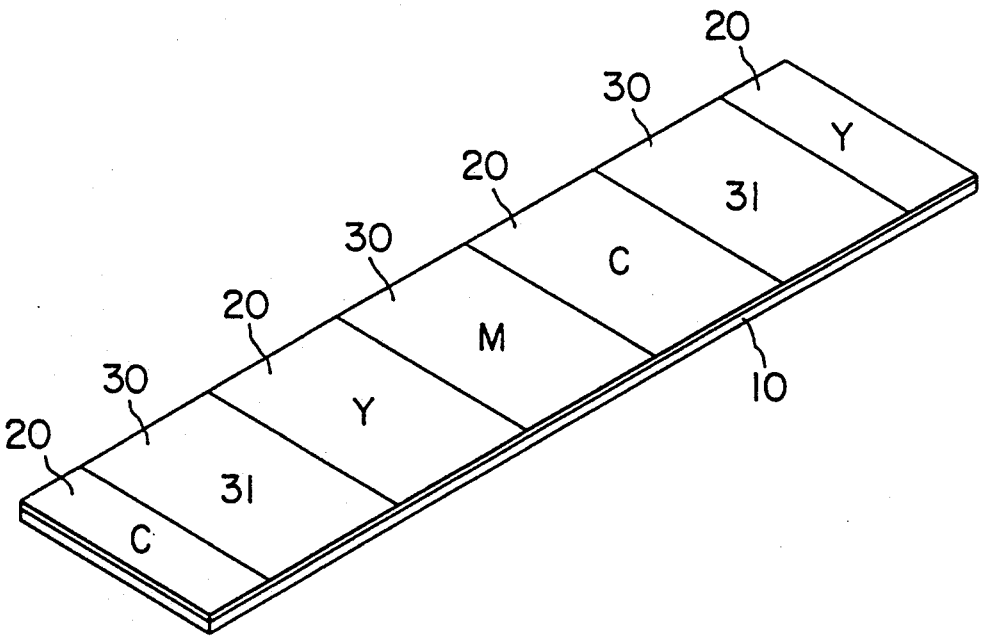

A heat transfer sheet according to this embodiment is prepared, as shown in FIG. 1, by forming a dye layer 20 on the surface of a substrate film 10, and forming a dye-transfer promoting layer 30 on the substrate film 10, next to the dye layer 20. In the embodiment shown in FIG. 10 dye layers of three colors of yellow (Y), cyan (C) and magenta (M) are formed with dye-transfer promoting layers 31, 32 and 33 respectively provided before each dye layer. However, it is not necessary to provide dye layers of three colors, but one, two, and even four colors including black are acceptable. Further, the dye-transfer promoting layer 30 can be provided either before or after each color dye layer. Alternatively, one region of the dye-transfer promoting layer can be provided per dye layers of three or four colors as shown in FIG. 2, in which the dye-transfer promoting layer 31 is provided before the dye layers of yellow (Y), magenta (M) and cyan (C) which are formed in this order. In this case, the dye-transfer promoting layer 31 is, at first, entirely transferred to a predetermined area in an image-receiving sheet. Further, in the case of a heat transfer sheet of an image-receiving-layer-transfer type, which contains a releasable image-receiving layer, a dye-transfer promoting layer can be formed on its substrate film together with an image-receiving layer and a dye layer. It is also acceptable to provide the dye-transfer promoting layer on a releasing layer which is formed on a substrate film.

The substrate films and the dyes mentioned in the heat transfer sheet (2) are all usable in the above heat transfer sheet.

In the present invention, the dye-transfer promoting layer is formed on the substrate film, next to the dye layer. A material preferably used for forming the dye-transfer promoting layer is a compound having the formula (I), and preferred examples of the material are the same as previously-enumerated Compounds 1 to 24.

The dye-transfer promoting layer comprising the above compound can be formed in the following manner:

Namely, the compound is dissolved or dispersed in an organic solvent to give a solution or dispersion having a low concentration of the compound. The solution or dispersion is coated onto the surface of the substrate film by a known method, and the solvent is then removed by evaporation to form the dye-transfer promoting layer. It is not necessary that the dye-transfer promoting layer be in a continuous film. The layer can exist non-continuously in the state of particles, as long as it is fused at a temperature elevated by heating when heat transfer recording is conducted, and forms a liquid phase. The thickness of the dye-transfer promoting layer is preferably from 0.01 to 1.0 g/m$^2$ when expressed in the coating amount. When the coating amount is less than the above range, the dye-transfer promoting effect cannot be satisfactorily obtained, while when it is in excess of the above range, the effect is reduced.

When forming the dye-transfer promoting layer, various binders and releasing agents such as described in the heat-transfer recording sheet (1) can be employed together with the compound having a low melting point as long as they do not disturb the accomplishment of the purposes of the present invention. Furthermore, various additives such as an ultraviolet absorbing agent and an antioxidant can also be incorporated into the dye-transfer promoting layer.

To conduct image recording, any heat transfer image-receiving sheet whose recording surface is receptive to the above dyes can be used in combination with the above heat transfer sheet of the present invention. Even those materials which are not receptive to the dyes, such as paper, metals, glass and synthetic resins can be used as heat transfer image-receiving sheets if they are provided with a dye-receiving layer on at least one surface of sheets or films of the above materials.

Any conventional means for applying thermal energy is employable when conducting heat transfer recording by using the above heat transfer sheet of the present invention and the above heat transfer image-receiving sheet in combination. For instance, recording apparatus such as a thermal printer, "Video Printer VY-100" ® manufactured by Hitachi Co., Ltd., are usable for the purpose. A desired image can be satisfactorily obtained by applying thermal energy, which is controllable by changing the printing time, in an amount of approximately from 5 to 100 mJ/mm$^2$ by the thermal printer to the heat transfer sheet.

The image forming process employing the above heat transfer sheet of the invention will now be explained by referring to FIG. 1. First, the heat transfer sheet is superposed on a heat transfer image-receiving sheet, which is not illustrated in the figure, so that the dye-transfer promoting layer 31 of the sheet and the dye-receiving layer of the image-receiving sheet can face each other. The dye-transfer promoting layer 31 is then transferred to the surface of the dye-receiving layer by means of a thermal head, a heat roller, or the like. Subsequently, the yellow dye layer (Y) of the heat transfer sheet is superposed on the dye-transfer promoting layer 31 transferred to the dye-receiving layer, and the yellow dye layer is transferred to produce a desired yellow image. The dye-transfer promoting layer 32 is then transferred to the above, and a desired magenta image is produced in the same manner as in the above. Finally, the dye-transfer promoting layer 33 is transferred, and then a desired cyan image is transferred in the same manner as in the above. A full-colored image can thus be obtained.

Image-Receiving Sheet (1)

The heat transfer image-receiving sheet according to the present invention comprises and a substrate film, a dye-receiving layer formed on at least one surface of the substrate film, and a dye-transfer promoting layer formed on the dye-receiving layer.

Examples of the substrate film usable in the present invention include sheets or films of synthetic papers such as of polyolefin type and polystyrene type, high quality paper, art paper, coated paper, cast-coated paper, wall paper, backing paper, synthetic resin or emulsion impregnated paper, synthetic rubber latex impregnated paper, synthetic resin internally added paper, cardboard, cellulose fiber paper, plastics such as polyolefins, polyvinylchloride, polyethyleneterephthalate, polystyrene, polymethacrylate and polycarbonate. In addition, a white opaque film prepared by using a mixture of a white pigment or a filler and the above-enumerated synthetic resin, and a foam sheet prepared by foaming the above mixture can be used as the substrate film. No limitation is thus imposed on the substrate film.

Moreover, a laminate which is prepared by the combination use of any of the above-described substrate films is also usable in the present invention. Typical examples of such a laminate are a laminate of cellulose fiber paper and synthetic paper, and a laminate of cellulose fiber paper and a plastic film or sheet. There is no particular limitation on the thickness of the substrate film. However, it is, in general, in the range of approximately from 10 to 300 μm.

In the case where sufficiently high adhesion between the substrate film and the dye-receiving layer formed thereon cannot be obtained, it is preferable to treat the surface of the substrate film with a primer or corona charge.

The dye-receiving layer formed on the substrate film is to receive the sublimable dye transferred from the heat transfer sheet, and to maintain an image produced therein.

Examples of a resin usable for forming the dye-receiving layer include polyolefin resins such as polypropylene, halogenated polymers such as polyvinyl chloride and polyvinylidene chloride, vinyl polymers such as polyvinyl acetate and polyacrylate, polyester resins such as polyethyleneterephthalate and polybutyleneterephthalate, polystyrene resins, polyamide resins, copolymer resins of an olefin such as ethylene or propylene and a vinyl monomer, ionomers, cellulose resins such as cellulose diacetate, and polycarbonate. Of these resins, vinyl resins and polyester resins are particularly preferable. Further, of the resins, those having a glass transition temperature of 30° C. or higher, preferably from 50° to 110° C., are preferably employed in the present invention.

The dye-receiving layer is formed on the substrate film in the following manner:

The above-described resin and needed additives are dissolved in a proper organic solvent, or dispersed in an organic solvent or water. The solution or dispersion thus obtained is coated onto at least one surface of the substrate film by means of gravure printing, screen printing, or a reverse roller coating which employs a gravure, and then dried to form the dye-receiving layer.

In order to enhance the whiteness of the dye-receiving layer to obtain a clear transferred image, pigments and fillers such as titanium oxide, zinc oxide, kaolin clay, calcium carbonate and finely divided particles of silica can be incorporated into the dye-receiving layer.

There is no particular limitation on the thickness of the dye-receiving layer. However, it is, in general, from 1 to 50 μm. Further, it is preferable that the dye-receiving layer be in a continuous film. However, non-continuous film formed by using a resin emulsion or a resin dispersion is also acceptable.

The heat transfer image-receiving sheet according to the present invention has basically the above-described structure, and is sufficient for attaining the purposes of the invention. However, it is also possible to incorporate a releasing agent into the dye-receiving layer so that the image-receiving sheet can be easily separated from a heat transfer sheet when heat transfer recording is conducted.

In the present invention, a dye-transfer promoting layer is formed on the surface of the dye-receiving layer. A material preferably used for forming the dye-transfer promoting layer is a compound having the formula (I), and preferred examples of the material are the same as previously-enumerated Compounds 1 to 24.

The dye-transfer promoting layer comprising the above compound can be formed in the following manner:

Namely, the compound is dissolved or dispersed in an organic solvent to give a solution or dispersion having a low concentration of the compound. The solution or dispersion is coated onto the surface of the dye-receiving layer by a known method, and the solvent is then removed by evaporation to form the dye-transfer promoting layer. It is not necessary that the dye-transfer promoting layer be in a complete continuous film. The layer can exist non-continuously in the state of particles, as long as it is fused at a temperature elevated by heating when heat transfer recording is conducted, and forms a liquid phase. The thickness of the dye-transfer promoting layer is preferably from 0.01 to 1.0 $g/m^2$ when expressed in the coating amount. When the coating amount is less than the above range, the dye-transfer promoting effect cannot be satisfactorily obtained, while when it is in excess of the above range, the effect is reduced.

When forming the dye-transfer promoting layer, various binders and releasing agents such as described in the heat-transfer sheet (1) can be employed together with the compound having a low melting point as long as they do not disturb the accomplishment of the purposes of the present invention. Furthermore, various additives such as an ultraviolet absorbing agent and an antioxidant can also be incorporated into the dye-transfer promoting layer.

By properly selecting the material of the substrate film, the image-receiving sheet of the invention is applicable to various uses, such as an image-receiving sheet or card in which an image can be thermally recorded, and a transparent sheet which is usable when preparing a manuscript.

In the present invention, a cushion layer may be provided between the substrate film and the dye-receiving layer, if necessary. When the cushion layer is provided, an image corresponding to image information can be obtained with less noise and high fidelity.

It is also acceptable to provide a smoothening layer on the back surface of the image-receiving sheet. Methacrylate resins or corresponding acrylic resins such as methylmethacrylate, and vinyl resins such as a copolymer of vinyl chloride and vinyl acetate can be used for forming the smoothening layer.

Moreover, it is also possible to provide a detecting mark on the image-receiving sheet. Such a mark is very useful for positioning of a heat transfer sheet and the image-receiving sheet. For instance, a mark which can be detected by a photoelectric tube detector can be provided on the back surface of the image-receiving sheet by means of printing or the like.

When conducting heat transfer recording by using the above heat transfer image-receiving sheet of the present invention, a heat transfer sheet which is prepared by forming a dye layer comprising a sublimable dye on a sheet of paper or a polyester film is employed. Any conventionally known heat transfer sheet is usable as it is in combination with the image-receiving sheet of the present invention.

Any conventional means for applying thermal energy is employable when conducting heat transfer recording. For instance, recording apparatus such as a thermal printer, "Video Printer VY-100" ® manufactured by Hitachi Co., Ltd., are usable for the purpose. A desired image can be satisfactorily obtained by applying thermal energy, which is controllable by changing the printing time, in an amount of approximately from 5 to 100 $mJ/mm^2$ by the thermal printer to the heat transfer sheet.

Image-Receiving Sheet (2)

In the conventional heat transfer recording methods, a heat transfer sheet is superposed on a heat transfer image-receiving sheet so that a dye layer of the recording sheet and a dye-receiving layer of the image-receiving sheet can face each other, and thermal energy is applied to the recording sheet by a thermal head to transfer the dye to the dye-receiving layer, thereby producing image therein. In addition, both the dye layer and the dye-receiving layer are prepared by using thermoplastic resins. For the above reasons, the heat transfer sheet and the heat transfer image-receiving sheet are thermally fused, and adhered to each other. As a result, they cannot be easily separated from each other, and a produced image tends to be damaged.

The above problems can be solved by incorporating a releasing agent into the dye-receiving layer. The releasing agent will bleed out the surface of the dye-receiving layer to form a releasing layer thereon.

In the above manner, when a liquid- or wax-type releasing agent is used, there are possibilities of staining an article which is brought into contact with the image-receiving sheet, and of causing fade in color of an image produced. According to the view of the inventors of the present invention, the above problems can be solved when a reaction-setting-type releasing agent is employed. When such an agent is incorporated into the dye-receiving layer, the agent bleeds out the surface of the dye-receiving layer, by heat treatment, after the formation thereof, whereby a thin cross-linked layer of the releasing agent is formed. The releasing agent of the above type thus can eliminate the above problems to some degree. However, when resins conventionally used for forming a dye-receiving layer are used, the releasing agent cannot bleed out the dye-receiving layer at proper timing. As a result, a releasing layer having sufficiently high releasability cannot be obtained. Even when a resin is properly selected, and used for forming a dye-receiving layer, sufficiently high printing sensitivity cannot be obtained.

The image-receiving sheet (2) of the present invention can reveal high releasability, high printing sensitivity, and high preservability at the same time.

Namely, the image-receiving sheet according to the present invention comprises a substrate sheet, a dye-receiving layer formed on at least one surface of the substrate sheet, and a releasing layer formed on the dye-receiving layer. The dye-receiving layer comprises a thermoplastic resin containing 0.1 to 8 wt. % of nitrogen, and a dye-transfer promoting agent comprising a compound which is in a crystalline state at room temperature and can be fused by thermal energy which is applied when heat transfer recording is conducted. The releasing layer comprises a catalyst-setting-type releasing agent containing an unsaturated bond. The substrate sheet is the same as in the image-receiving sheet (1).

The dye-receiving layer formed on the surface of the substrate sheet is to receive a sublimable dye transferred from a heat transfer sheet, and to maintain an image produced therein.

A thermoplastic resin containing 0.1 to 8 wt. % of nitrogen is used for forming the dye-receiving layer. The source of the nitrogen contained in the resin is such a bond as an urethane bond, an urea bond, an amide bond and an imide bond. Examples of the resin include various thermoplastic resins such as a polyurethane resin, a polyamide resin, a polyimide resin, an acrylic resin, and an epoxy resin. Of these resins, an urethane-modified polyester resin is particularly preferred.

The urethane-modified resin is readily obtainable by reacting aromatic or aliphatic dicarboxylic acid with an excess amount of aliphatic diol to give polyester diol having a proper molecular weight, and reacting the aliphatic diol with polyisocyanate which will be described later, or modifying the aliphatic diol by a chain lengthening agent such as diol or diamine. The polyester diol may be treated together with other polyester diol such as acrylic diol or polycarbonate diol.

In the case where the content of the nitrogen in the resin is less than 0.1 wt. %, printing sensitivity is low, and the releasing agent has low bleeding ability. Moreover, compatibility between such a resin and the dye-transfer promoting agent (sensitizing agent) having an urethane bond and/or urea bond is low, so that the components of the dye-receiving layer cannot be thoroughly dispersed therein, and the printing suitability thus deteriorates. On the other hand, when the nitrogen content in the resin exceeds 8 wt. %, sensitivity is reduced, bleeding ability of the releasing agent is decreased, and the compatibility between the resin and the sensitizing agent is lowered. When the nitrogen content is in the range of 1 to 3 wt. %, the best results can be obtained.

It is preferable that the above nitrogen-containing resin have a glass transition temperature of 70° C. or higher. When the glass transition temperature is lower than 70° C., the dye-receiving layer will be adhered by fusion to a heat transfer sheet when heat transfer recording is conducted, and an image produced in the dye-receiving layer will be blurred. When the glass transition temperature is too high, dye-receptivity of the dye-receiving layer is reduced, and compatibility between the resin and the sensitizing agent is decreased. The preferable range of the glass transition temperature is from 70° C. to 120° C.

In the present invention, other thermoplastic resins such as a polyester resin and a polyvinyl resin can be co-employed when forming the dye-receiving layer as long as they do not disturb the accomplishment of the purposes of the present invention.

The dye-transfer promoting agent for use in the present invention is a compound containing two or more urethane bonds and/or urea bonds, having a relatively low molecular weight. The molecular weight of the compound is preferably from 100 to 1,500, more preferably from 300 to 500. The melting point of the compound is preferably from 60 to 130° C. In the case where a compound having a molecular weight of less than 100, or a melting point of lower than 60° C. is used, the compound (sensitizing agent) easily migrates to the surface of the dye-receiving layer. As a result, some problems such as of blocking are caused. When a compound having a molecular weight of more than 1,500, or a melting point of higher than 130° C. is used, the sensitizing effects such as dyeability of the dye are drastically reduced. In the present invention, the compound having the formula (I) is preferably used as the compound having a low melting point, and preferred examples of the compound is the same as the previously-enumerated Compounds 1 to 24.

It is preferable that the amount of the dye-transfer promoting agent be from 5 to 70 parts by weight for 100 parts by weight of the above-described resin used for forming the dye-receiving layer. When the amount of the dye-transfer promoting agent is less than 5 parts by weight, sensitizing effect cannot be satisfactorily obtained; while when the amount is more than 70 parts by weight, heat resistance and film strength of the dye-receiving layer are reduced, and compatibility between the resin and the dye-transfer promoting agent is lowered.

It is preferable that the dye-transfer promoting agent is existing in the dye-receiving layer in the dissolved state. The dissolved state herein includes a molecular dispersion state. The dye-transfer promoting agent for use in the present invention is, in general, excellent in solubility. In the case where compatibility between the binder and the dye-transfer promoting agent contained in the dye-receiving layer is low, the dye-transfer promoting agent will bleed out the dye-receiving layer, or will bloom thereon during the preservation, resulting in decay of the dye-receiving layer. It is therefore necessary to give care to the compatibility.

The heat transfer image-receiving sheet according to the present invention can be prepared in the following manner:

The above-described resin, the dye-transfer promoting agent, and additives such as a releasing agent are dissolved in a proper organic solvent, or dispersed in an organic solvent or water. The solution or dispersion thus obtained is coated onto at least one surface of the above-described substrate sheet by means of gravure printing, screen printing, or reverse roller coating which employs a gravure, and then dried, followed by heating, thereby forming the dye-receiving layer, and the releasing layer thereon.

In order to enhance the whiteness of the dye-receiving layer to clearly obtain a transferred image, pigments and fillers such as titanium oxide, zinc oxide, kaolin clay, calcium carbonate and finely divided particles of silica can be incorporated into the dye-receiving layer. In addition, in order to improve light and heat stabilities of the dye-receiving layer, light stabilizers such as an ultraviolet absorbing agent and an antioxidant, and heat stabilizers can be incorporated into the dye-receiving layer.

In the present invention, a catalyst-setting-type releasing agent containing an unsaturated bond is incorporated into the dye-receiving layer in order to impart releasability thereto.

The catalyst-setting-type releasing agent containing an unsaturated bond for use in the present invention is a compound which contains an unsaturated group such as a vinyl group or a (meth)acryl group, and forms a cross-linked film when reacted with a hardening agent (catalyst). Preferred examples of the releasing agent of this type include polydimethylsiloxane having the following formula:

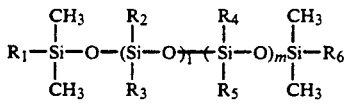

in which at least one of $R_1$ to $R_6$ is a group containing an unsaturated group. The crosslinking in the catlyst-reactive releasing agent takes place when a crosslinking agent or a catalyst is reacted therewith. Moreover, the crosslinking reaction can be accelerated by application of heat or ionizing radiation such as an ultraviolet ray or electron beam.

A non-reactive releasing agent can be employed together with the catalyst-setting-type releasing agent containing an unsaturated bond. In this case, the amount of the non-reactive releasing agent is preferably 30 wt. % or less of the weight of the catalyst-setting-type releasing agent.

The total amount of the releasing agents is preferably from 0.5 to 30 parts by weight for the 100 parts by weight of the resin contained in the dye-receiving layer. When the amount is outside the above range, a dye layer of a heat transfer sheet and the dye-receiving layer are adhered to each other by fusion when recording is conducted, and printing sensitivity is also reduced.

A coating liquid for forming the dye-receiving layer to which is added the releasing agent is coated onto the substrate sheet. The releasing agent bleeds out the dye-receiving layer when heated upon the formation of the dye-receiving layer. The releasing layer is thus formed on the dye-receiving layer.

No particular limitation is imposed on the thickness of the dye-receiving layer. However, it is, in general, from 1 to 50 μm. Further, it is preferable that the dye-receiving layer be in a continuous film. However, a non-continuous film formed by using a resin emulsion or a resin dispersion is also acceptable.

It is preferable that the glass transition temperature of the whole dye-receiving layer be 60° C. or higher. When the glass transition temperature is lower than 60° C. the problems of blocking and blur of an image will be caused.

By properly selecting the material of the substrate film, the image-receiving sheet of the present invention is applicable to various uses, such as an image-receiving sheet or card in which an image can be thermally recorded, and a transparent sheet which is usable when preparing a manuscript.

In the present invention, a cushion layer may be provided between the substrate film and the dye-receiving layer, if necessary. When the cushion layer is provided, an image corresponding to image information can be obtained with less noise and high fidelity.

Examples of the material for forming the cushion layer include a polyurethane resin, an acrylic resin, a polyethylene resin, a butadiene rubber and an epoxy resin. The thickness of the cushion layer is preferably from 2 to 20 μm.

It is also acceptable to provide a smoothening layer on the back surface of the substrate sheet. Methacrylate resins or corresponding acrylic resins such as methylmethacrylate, and vinyl resins such as a copolymer of vinyl chloride and vinyl acetate can be used for forming the smoothening layer. To such a resin, a filler may also be incorporated.

Furthermore, it is also acceptable to provide a detecting mark on the image-receiving sheet. Such a mark is very useful for positioning of a heat transfer sheet and the image-receiving sheet. For instance, a mark which can be detected by a photoelectric tube detector can be provided on the back surface of the substrate sheet by means of printing or the like.

In addition, an antistatic agent can be incorporated into or applied to at least one surface layer of the image-receiving sheet to prevent static electrification.

When conducting heat transfer recording by using the above heat transfer image-receiving sheet of the present invention, a heat transfer sheet which is prepared by forming a dye layer comprising a sublimable dye on a sheet of paper or a polyester film is employed. Any conventionally known heat transfer sheet is usable as it is in combination with the image-receiving sheet of the invention.

Any conventional means for applying thermal energy is employable when conducting heat transfer recording. For instance, recording apparatus such as a thermal printer, "Video Printer VY-100" ® manufactured by Hitachi Co., Ltd., are usable for the purpose. A desired image can be satisfactorily obtained by applying thermal energy, which is controllable by changing the printing time, in an amount of approximately from 5 to 100 $mJ/mm^2$ by the thermal printer to the heat transfer sheet.

Heat Transfer Recording Method

Figure 3:
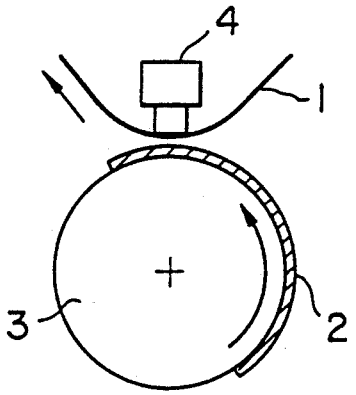
FIG. 3 to FIG. 5 are illustrations showing the heat transfer recording methods according to the present invention.
Figure 4:
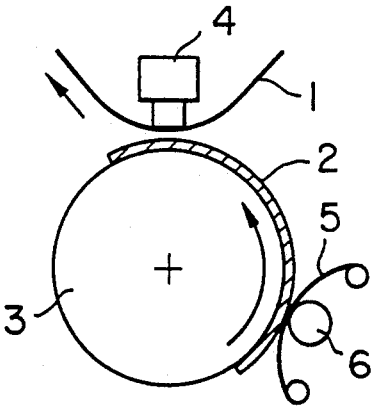
Figure 5:
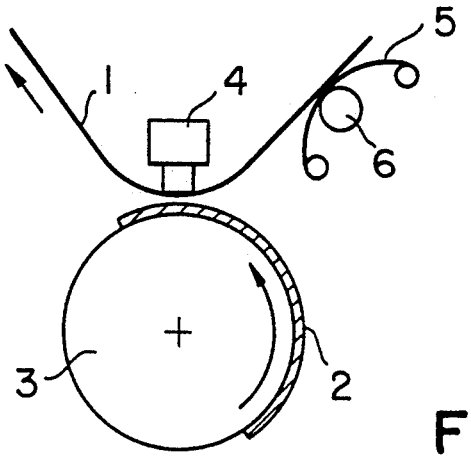

The heat transfer recording methods according to the present invention, shown in FIGS. 3 to 5, comprising the steps of superposing at heat transfer sheet 1 on a heat transfer image-receiving sheet 2 placed on a platen 3, and applying thermal energy imagewise to the back surface of the heat transfer sheet by a thermal head 4 to produce an image in a dye-receiving layer of the image-receiving sheet, are characterized in that a dye-transfer promoting agent which can be fused by thermal energy which is applied when heat transfer recording is conducted is given to the dye layer of the heat transfer sheet an/or the dye-receiving layer of the heat transfer image-receiving sheet before the formation of the image.

As the dye-transfer promoting agent, the compound having the formula (I) is suitably used in the present invention. Preferred examples of the agent are the same as the previously-enumerated Compounds 1 to 24.

The dye-transfer promoting agent can be given to the dye layer and/or dye-receiving layer in any manner. However, the following methods are preferred:

(1) A method shown in FIG. 3, in which a heat transfer sheet as shown in FIG. 1 or FIG. 2, comprising a dye layer 20 and the dye-transfer promoting layer 30 provided next to it is employed.

The heat transfer sheet for use in this method is prepared by forming a dye layer 20 on a substrate film 10 in the same manner as in the prior art, and providing a dye-transfer promoting layer 30 on the substrate film 10, next to the dye layer 20 as shown in FIG. 1. The heat transfer sheet shown in FIG. 1 is prepared by providing dye layers of three colors of yellow (Y), cyan (C) and magenta (M), and respectively providing dye-transfer promoting layers 31, 32 and 33 before each dye layer. However, it is not necessary to provide dye layers of three colors, but one, two, and even four colors including black are acceptable. Further, the dye-transfer promoting layer 30 can be provided before or after each color dye layer. Alternatively, one region of the dye-transfer promoting layer can be provided per dye layers of three or four colors as shown in FIG. 2, in which the dye-transfer promoting layer 31 is provided before the dye layers of yellow (Y), magenta (M) and cyan (C) which are formed in this order. In this case, the dye-transfer promoting layer 31 is, at first, entirely transferred to a predetermined area in an image-receiving sheet.

The conventional substrate films and dye layers can be used in the above. The dye-transfer promoting layer is formed in the following manner:

The above-described compound having a low melting point is dissolved or dispersed in an organic solvent to give a solution in dispersion having a low concentration of the compound. The solution or dispersion is coated onto the substrate film by one of known coating methods, and then the solvent is removed by evaporation to form the dye-transfer promoting layer. It is not necessary that the dye-transfer promoting layer be in a complete continuous film. The layer can exist non-continuously in the state of particles as long as the particles can be fused by thermal energy which is applied when heat transfer recording is conducted, and form a liquid phase. The thickness of the dye-transfer promoting layer is preferably from 0.01 to 1.0 g/m$^2$ when expressed in the coating amount. When the coating amount is less than the above range, dye-transfer promoting effect cannot be satisfactorily obtained; while when the coating amount exceeds the above range, the dye-transfer promoting effect is reduced.

When forming the dye-transfer promoting layer, various binders and releasing agents can be employed together with the compound having a low melting point as long as they do not disturb the accomplishment of the purposes of the invention. Moreover, various additives such as an ultraviolet absorbing agent and an antioxidant are also employable.

The image producing method using the above heat transfer sheet will now be explained by referring to FIG. 3 and FIG. 1. First, the heat transfer sheet 1 is superposed on a heat transfer image-receiving sheet 2 placed on a platen 3 so that the dye-transfer promoting layer 31 of the heat transfer sheet and a dye-receiving layer of the image-receiving sheet can face each other. The dye-transfer promoting agent 31 is transferred to the surface of the dye-receiving layer by means of a thermal head or a heat roller. Subsequently, a yellow dye layer (Y) of the heat transfer sheet is superposed on the dye-transfer promoting layer 31 transferred on the dye-receiving layer, thereby producing a desired yellow image in the same manner as in the above. The dye-transfer promoting layer 32 is then transferred to the above, and a desired magenta image is formed thereon. Finally, the dye-transfer promoting layer 33 is transferred, and a cyan image is formed thereon in the same manner as in the above. A full-colored image can thus be obtained.

(2) A method shown in FIG. 4, in which a dye-transfer promoting agent is transferred to a dye-receiving layer of a heat transfer image-receiving sheet 2 by using a heat-transferable dye-transfer promoting agent sheet 5.

The heat-transferable dye-transfer promoting agent sheet for use in this method can be prepared by forming a layer comprising a dye-transfer promoting agent (dye-transfer promoting layer) on the entire surface of a substrate film which is the same as the substrate film of the heat transfer sheet for use in the above method (1).

The image producing method employing the heat-transferable dye-transfer promoting agent sheet 5 will now be explained by referring to FIG. 4. First, the heat-transferable dye-transfer promoting agent sheet 5 is superposed on the heat transfer image-receiving sheet 2 placed on a platen 3 so that the dye-transfer promoting layer and a dye-receiving layer of the image-receiving sheet can face each other. The dye-transfer promoting layer is then transferred to the dye-receiving layer by means of a thermal head or a heat roller 6. The yellow dye layer of the heat transfer sheet 1 is then superposed on the dye-transfer promoting layer transferred on the dye-receiving layer, thereby producing a desired yellow image thereon. Thereafter, a magenta image, and a cyan image are successively transferred. A full-colored image can thus be produced.

(3) A method shown in FIG. 5, in which a heat-transfer promoting agent is transferred to the dye layer of the heat transfer sheet 1 by using a heat-transferable dye-transfer promoting agent sheet 5.

In this method, the dye-transfer promoting agent is transferred to the dye layer of the heat transfer sheet by using the same heat-transferable dye-transfer promoting agent sheet as employed int he above method (2). Thereafter, the dye contained in the dye layer is transferred to a dye-receiving layer of a heat transfer image-receiving sheet. A full-color image can thus be obtained.

The above-described methods are preferred ones, and the following method is also acceptable:

The dye-transfer promoting agent is dissolved in a volatile solvent such as alcohol. The resulting thin solution of the promoting agent is coated onto the surface of the heat transfer sheet and/or image-receiving sheet by means of coating or spraying.

When conducting heat transfer recording by using the above-described heat transfer sheet and heat transfer image-receiving sheet, any conventional means for applying thermal energy is employable. For instance, recording apparatus such as a thermal printer, "Video Printer VY-100" (Trademark) manufactured by Hitachi Co., Ltd., are usable for the purpose. A desired image can be satisfactorily obtained by applying thermal energy, which is controllable by changing the printing time, in an amount of approximately from 5 to 100 mJ/mm$^2$ by the thermal printer to the heat transfer sheet.

This invention will now be explained more specifically with reference to the following Examples and Comparative Examples. The Examples are given for illustrating of this invention and are not intended to be limiting thereof. Throughout the Examples and the Comparative Examples, quantities expressed in "parts" and "%" are "parts by weight" and "percent by weight", respectively.

EXAMPLES A1 to A26

An ink composition for forming a dye layer, having the following formulation, was coated onto the surface of a substrate film, a polyethyleneterephthalate film 6 μm thick with its back surface imparted with heat resistance, in an amount of 1.0 g/m$^2$ on dry basis by means of gravure printing, and then dried to form a dye layer. Heat transfer sheets according to the present invention were thus respectively obtained as continuous films.

| [Ink Composition for Forming Dye Layer] | |
|---|---|
| C.I. Solvent Blue 63 ("Kayaset Blue 714" manufactured by Nippon Kayaku Co., Ltd.) | 100 parts |
| Polyvinyl butyral resin ("S-Lec BX-1" manufactured by Sekisui Chemical Co., Ltd.) | 100 parts |
| Compound having formula (I) | (shown in Table A1) |
| Methyl ethyl ketone | 600 parts |
| Toluene | 1700 parts |

It is noted that the type and the amount of the compound having the formula (I) (sensitizing agent) employed are shown in Table A1.

COMPARATIVE EXAMPLE A1

A comparative heat transfer sheet was prepared in the same manner as in Example A1 without using the sensitizing agent.

Preparation of Heat Transfer Image-Receiving Sheets

A coating liquid for forming a dye-receiving layer, having the following formulation, was coated onto one surface of a substrate film, synthetic paper ("Yupo FPG 150" (Trademark) manufactured by Oji-Yuka Synthetic Paper Co., Ltd.), in an amount of 4.5 g/m$^2$ on dry basis, and then dried at 100° C. for 30 minutes to form a dye-receiving layer. A heat transfer image-receiving sheet for use with the heat transfer recording sheets according to the present invention and with the comparative one was thus obtained.

| [Coating Liquid for Forming Dye-Receiving Layer] | |
|---|---|
| Polyester resin ("Vylon 200" manufactured by Toyobo Co., Ltd.) | 11.5 parts |
| Vinyl chloride - vinyl acetate copolymer ("VYHH" manufactured by Union Carbide Corp.) | 5.0 parts |
| Amino-modified silicone oil ("KF 393" manufactured by Shin-Etsu Chemical Co., Ltd.) | 1.2 parts |
| Epoxy-modified silicone oil ("X-22-343" manufactured by Shin-Etsu Chemical Co., Ltd.) | 1.2 parts |
| Methyl ethyl ketone | 40.8 parts |
| Toluene | 40.8 parts |
| Cyclohexanone | 20.4 parts |

Heat Transfer Recording Tests

The heat transfer sheets obtained in Examples A1 to A26 and Comparative Example A1 were respectively superposed on the above-prepared heat transfer image-receiving sheet so that the dye layer faced the image-receiving layer. Thermal energy was then applied to the back surface of the heat transfer sheet by using a thermal head (KMT-85-6, MPD 2) to conduct thermal head recording under the following conditions:

| | |
|---|---|
| Electric voltage applied: | 12.0 V |
| Pulse width applied: | step pattern method was applied, reduced stepwise from 16.0 msec/line at every 1 msec |
| Density in sub-scanning direction: | 6 line/mm (33.3 msec/line) |

The results are shown in below Table A1.

TABLE A1

| Example | Sensitizing agent & its amount employed | | Relative sensitivity | Back side transfer | Blocking |
|---|---|---|---|---|---|
| A1 | No. 1 | 20 parts | 1.53 | ◎ | ○ |
| A2 | No. 2 | 20 parts | 1.61 | ◎ | ◎ |
| A3 | No. 3 | 20 parts | 1.80 | ◎ | ◎ |
| A4 | No. 4 | 20 parts | 1.45 | ◎ | ○ |
| A5 | No. 5 | 20 parts | 1.72 | ○ | ◎ |
| A6 | No. 6 | 20 parts | 1.36 | ◎ | ◎ |
| A7 | No. 7 | 20 parts | 1.57 | ○ | ◎ |
| A8 | No. 8 | 20 parts | 1.41 | ○ | ◎ |
| A9 | No. 2 | 1 part | 1.05 | ◎ | ◎ |
| A10 | No. 2 | 5 parts | 1.21 | ◎ | ◎ |
| A11 | No. 2 | 150 parts | 2.05 | ○ | ○ |
| A12 | No. 2 | 200 parts | 2.20 | Δ | Δ |
| A13 | No. 9 | 20 parts | 1.62 | ○ | ◎ |
| A14 | No. 10 | 20 parts | 1.55 | ◎ | ◎ |
| A15 | No. 11 | 20 parts | 1.67 | ◎ | ◎ |
| A16 | No. 12 | 20 parts | 1.74 | ○ | ○ |
| A17 | No. 13 | 20 parts | 1.59 | ◎ | ◎ |
| A18 | No. 14 | 20 parts | 1.82 | ○ | ◎ |
| A19 | No. 15 | 20 parts | 1.72 | ○ | ○ |
| A20 | No. 16 | 20 parts | 1.58 | ○ | ◎ |
| A21 | No. 17 | 20 parts | 1.78 | ◎ | ◎ |
| A22 | No. 18 | 20 parts | 1.81 | ◎ | ◎ |
| A23 | No. 19 | 20 parts | 1.77 | ◎ | ◎ |
| A24 | No. 20 | 20 parts | 1.52 | ○ | ◎ |
| A25 | No. 21 | 20 parts | 1.49 | ◎ | ○ |
| A26 | No. 22 | 20 parts | 1.63 | ○ | ◎ |
| Comparative Example A1 | Not used | | 1.00 | ○ | ◎ |

Note

Relative sensitivity: The density of the image printed by using the comparative heat transfer sheet was measured and indicated by 1.00, and those of the images printed by using the other recording sheets were respectively measured and indicated by relative values thereto.

Transfer of dye: A piece of the heat transfer sheet was superposed on another piece of the sheet so that the dye layer faced the back surface of the substrate film which had been imparted with heat resistance. This sample was allowed to stand at 60° C. for 24 hours while pressing with a load of 20 g/m$^2$, and then cooled to room temperature, followed by separation. The resulting sheets were visually observed as to whether the dye contained in the dye layer was transferred to the back surface of the substrate film. The evaluation standards are as follows:

◎: The back surface of the substrate film was not stained with the dye, excellent;

○: Good

Δ: Transfer of the dye to the back surface of the substrate film was slightly found; and x: Transfer of the dye to the back surface of the substrate film was remarkable.

Blocking: The same procedure as in the test of the above "Transfer of dye" was repeated, and upon separating the recording sheets from each other, releasability and adhesion between the dye layer and the substrate film, and the degree of cohesive failure caused in the dye layer were evaluated. The evaluation standards are as follows:

◎: Smoothly releasable without any resistance, excellent;

○: Good;

Δ: Releasable with resistance; and x: Hard to release due to adhesion or cohesive failure.

It can thus be known that, according to the above present invention, a heat transfer sheet which can produce an image having a sufficiently high density with application of printing energy in a smaller amount than that of printing energy required in the conventional recording methods, and can produce an image having a higher density than the above with application of printing energy in the same amount as applied in the conventional recording methods is obtainable by incorporating a compound having the formula (I) into a dye layer.

It is considered that the above effects can be obtained due to the following reason: the compound (I) can be fused very easily and sharply when thermal energy is applied by a thermal head, so that the compound can migrate in the dye layer when heat transfer recording is conducted, and migration of the dye is also remarkably improved.

EXAMPLES B1 TO B28 AND COMPARATIVE EXAMPLE B1

An ink composition for forming a dye layer, having the following formulation, was coated onto the surface of a substrate film, a polyethyleneterephthalate film 6 μm thick with its back surface imparted with heat resistance, in an amount of 1.0 g/m$^2$ on dry basis by means of gravure printing, and then dried to form a dye layer.

| [Ink Composition for Forming Dye Layer] | |
|---|---|
| C.I. Solvent Blue 63 ("Kayaset Blue 714" manufactured by Nippon Kayaku Co., Ltd.) | 5.50 parts |
| Polyvinyl butyral resin ("S-Lec BX-1" manufactured by Sekisui Chemical Co., Ltd.) | 3.00 parts |
| Methyl ethyl ketone | 22.54 parts |
| Toluene | 68.18 parts |

Thereafter, a 5% ethyl alcohol solution of the compound having a low melting point shown in Table B1 was coated onto the surface of the above dye layer by a gravure coater, and then dried to form a dye-transfer promoting layer. The coating amount (g/m$^2$) of the solution on solid basis is shown in the table. Heat transfer sheets of the present invention and a comparative heat transfer sheet were thus respectively obtained as continuous films.

Preparation of Heat Transfer Image-Receiving Sheet

A coating liquid for forming a dye-receiving layer, having the following formulation, was coated onto one surface of a substrate film, synthetic paper ("Yupo FPG 150" (Trademark) manufactured by Oji-Yuka Synthetic Paper Co., Ltd.), in an amount of 4.5 g/m$^2$ on dry basis, and then dried at 100° C. for 30 minutes to form a dye-receiving layer. A heat transfer image-receiving sheet for use with the heat transfer sheets according to the present invention and the comparative one was thus obtained.

| [Coating Liquid for Forming Dye-Receiving Layer] | |
|---|---|
| Polyester resin ("Vylon 200" manufactured by Toyobo Co., Ltd.) | 11.5 parts |
| Vinyl chloride - vinyl acetate copolymer ("VYHH" manufactured by Union Carbide Corp.) | 5.0 parts |
| Amino-modified silicone oil ("KF 393" manufactured by Shin-Etsu Chemical Co., Ltd.) | 1.2 parts |
| Epoxy-modified silicone oil ("X-22-343" manufactured by Shin-Etsu Chemical Co., Ltd.) | 1.2 parts |
| Methyl ethyl ketone | 40.8 parts |
| Toluene | 40.8 parts |
| Cyclohexanone | 20.4 parts |

TABLE B1

| | Compound having a low melting point | Coating amount g/m$^2$ |
|---|---|---|
| Example B1 | Below-described Compound 1* | 0.31 |
| Example B2 | Below-described Compound 2* | 0.29 |
| Example B3 | Below-described Compound 3* | 0.33 |
| Example B4 | Below-described Compound 4* | 0.37 |
| Example B5 | Previously-enumerated Compound 1 | 0.28 |
| Example B6 | Previously-enumerated Compound 2 | 0.25 |
| Example B7 | Previously-enumerated Compound 3 | 0.29 |
| Example B8 | Previously-enumerated Compound 4 | 0.32 |
| Example B9 | Previously-enumerated Compound 5 | 0.34 |
| Example B10 | Previously-enumerated Compound 6 | 0.31 |
| Example B11 | Previously-enumerated Compound 7 | 0.27 |
| Example B12 | Previously-enumerated Compound 8 | 0.33 |
| Example B13 | Previously-enumerated Compound 9 | 0.29 |
| Example B14 | Previously-enumerated Compound 10 | 0.30 |
| Example B15 | Previously-enumerated Compound 11 | 0.32 |
| Example B16 | Previously-enumerated Compound 12 | 0.34 |
| Example B17 | Previously-enumerated Compound 13 | 0.27 |
| Example B18 | Previously-enumerated Compound 14 | 0.31 |
| Example B19 | Previously-enumerated Compound 15 | 0.29 |
| Example B20 | Previously-enumerated Compound 16 | 0.33 |
| Example B21 | Previously-enumerated Compound 17 | 0.25 |
| Example B22 | Previously-enumerated Compound 18 | 0.30 |
| Example B23 | Previously-enumerated Compound 19 | 0.27 |
| Example B24 | Previously-enumerated Compound 20 | 0.28 |
| Example B25 | Previously-enumerated Compound 21 | 0.33 |
| Example B26 | Previously-enumerated Compound 22 | 0.29 |
| Example B27 | Previously-enumerated Compound 23 | 0.32 |
| Example B28 | Previously-enumerated Compound 24 | 0.32 |
| Comp. Exam. B1 | Not used | — |

*Compound 1: $CH_2$—[NHCOO—$(CH_2)_2$—$CH_3]_2$
*Compound 2: $(CH_2)_2$—[NHCOO—$(CH_2)_3$—$CH_3]_2$
*Compound 3: $(CH_2)_3$—[NHCOO—$(CH_2)_2$—$CH_3]_2$
*Compound 4: $CH_2$—[NHCOO—$(CH_2)_3$—$CH_3]_2$

Heat Transfer Recording Test

The heat transfer sheets obtained in Examples B1 to B28 and Comparative Example B1 were respectively superposed on the above-prepared heat transfer image-receiving sheet so that the dye layer faced the dye-receiving layer. Thermal energy was then applied to the back surface of the heat transfer sheet by using a thermal head (KMT-85-6, MPD 2) to conduct thermal head recording under the following conditions:

| | |
|---|---|
| Electric voltage applied: | 12.0 V |
| Pulse width applied: | step pattern method was applied, reduced stepwise from 16.0 msec/line at every 1 msec |
| Density in sub-scanning direction: | 6 line/mm (33.3 msec/line) |

The results are shown in below Table B2.

TABLE B2

| Heat transfer sheet | Relative Sensitivity |
|---|---|
| Example B1 | 1.8 |
| Example B2 | 1.6 |
| Example B3 | 1.5 |
| Example B4 | 1.7 |
| Example B5 | 1.8 |
| Example B6 | 1.6 |
| Example B7 | 1.5 |
| Example B8 | 1.9 |
| Example B9 | 1.8 |
| Example B10 | 1.8 |
| Example B11 | 1.5 |
| Example B12 | 1.9 |
| Example B13 | 1.8 |
| Example B14 | 1.8 |
| Example B15 | 1.8 |
| Example B16 | 1.7 |
| Example B17 | 1.7 |
| Example B18 | 1.8 |
| Example B19 | 1.6 |
| Example B20 | 1.8 |
| Example B21 | 1.5 |
| Example B22 | 1.5 |
| Example B23 | 1.7 |
| Example B24 | 1.7 |
| Example B25 | 1.8 |
| Example B26 | 1.7 |
| Example B27 | 1.6 |
| Example B28 | 1.7 |
| Comp. Exam. B1 | 1.0 |

The relative sensitivities were determined as follows: The density of the image printed by using the comparative heat transfer sheet was measured and indicated by 1.0, and those of the images printed by using the other recording sheets were respectively measured and indicated by relative values thereto.

It can thus be known that according to the above present invention, a heat transfer sheet which can produce an image having a 50% or more improved density with application of printing energy in the same amount as required in the conventional recording methods is obtainable by providing a dye-transfer promoting layer on a dye layer.

EXAMPLES C1 TO C28

An ink composition for forming a dye layer, having the following formulation, was coated onto the surface of a substrate film, a polyethyleneterephthalate film 6 μm thick with its back surface imparted with heat resistance, in an amount of 1.0 g/m$^2$ on dry basis, in a width of 30 cm, by means of gravure printing, and then dried to form a dye layer.

| Ink Composition for Forming Dye Layer | |
|---|---|
| C.I. Solvent Blue 63 ("Kayaset Blue 714" manufactured by Nippon Kayaku Co., Ltd.) | 5.50 parts |
| Polyvinyl butyral resin ("S-Lec BX-1" manufactured by Sekisui Chemical Co., Ltd.) | 3.00 parts |
| Methyl ethyl ketone | 22.54 parts |
| Toluene | 68.18 parts |

Thereafter, a 5% ethyl alcohol solution of the compound having a low melting point shown in Table C1 was coated onto the substrate film, next to the above-formed dye layer, in a width of 30 cm, by a gravure coater, and then dried to form a dye-transfer promoting layer. The coating amount (g/m$^2$) of the solution on solid basis is shown in Table C1. Heat transfer sheets of the present invention were thus obtained as continuous films.

Preparation of Heat Transfer Image-Receiving Sheet

A coating liquid for forming a dye-receiving layer, having the following formulation, was coated onto one surface of a substrate film, synthetic paper ("Yugo FPG 150" (Trademark) manufactured by Oji-Yuka Synthetic Paper Co., Ltd.), in an amount of 4.5 g/m$^2$ on dry basis, and then dried at 100° C. for 30 minutes to form a dye-receiving layer. A heat transfer image-receiving sheet for use with the heat transfer sheets according to the present invention and the comparative one was thus obtained.

| Coating Liquid for Forming Dye-Receiving Layer | |
|---|---|
| Polyester resin ("Vylon 200" manufactured by Toyobo Co., Ltd.) | 11.5 parts |
| Vinyl chloride - vinyl acetate copolymer ("VYHH" manufactured by Union Carbide Corp.) | 5.0 parts |
| Amino-modified silicone oil ("KF 393" manufactured by Shin-Etsu Chemical Co., Ltd.) | 1.2 parts |
| Epoxy-modified silicone oil ("X-22-343" manufactured by Shin-Etsu Chemical Co., Ltd.) | 1.2 parts |
| Methyl ethyl ketone | 40.8 parts |
| Toluene | 40.8 parts |
| Cyclohexanone | 20.4 parts |

TABLE C1

| | Compound having a low melting point | Coating amount g/m$^2$ |
|---|---|---|
| Example C1 | Below-described Compound 1* | 0.86 |
| Example C2 | Below-described Compound 2* | 0.91 |
| Example C3 | Below-described Compound 3* | 0.62 |
| Example C4 | Below-described Compound 4* | 0.77 |
| Example C5 | Previously-enumerated Compound 1 | 0.52 |
| Example C6 | Previously-enumerated Compound 2 | 0.78 |
| Example C7 | Previously-enumerated Compound 3 | 0.23 |
| Example C8 | Previously-enumerated Compound 4 | 0.91 |
| Example C9 | Previously-enumerated Compound 5 | 0.49 |
| Example C10 | Previously-enumerated Compound 6 | 0.63 |
| Example C11 | Previously-enumerated Compound 7 | 0.21 |
| Example C12 | Previously-enumerated Compound 8 | 0.73 |

TABLE C1-continued

| | Compound having a low melting point | Coating amount g/m² |
|---|---|---|
| Example C13 | Previously-enumerated Compound 9 | 0.35 |
| Example C14 | Previously-enumerated Compound 10 | 0.64 |
| Example C15 | Previously-enumerated Compound 11 | 0.72 |
| Example C16 | Previously-enumerated Compound 12 | 0.64 |
| Example C17 | Previously-enumerated Compound 13 | 0.68 |
| Example C18 | Previously-enumerated Compound 14 | 0.82 |
| Example C19 | Previously-enumerated Compound 15 | 0.68 |
| Example C20 | Previously-enumerated Compound 16 | 0.72 |
| Example C21 | Previously-enumerated Compound 17 | 0.85 |
| Example C22 | Previously-enumerated Compound 18 | 0.58 |
| Example C23 | Previously-enumerated Compound 19 | 0.62 |
| Example C24 | Previously-enumerated Compound 20 | 0.66 |
| Example C25 | Previously-enumerated Compound 21 | 0.84 |
| Example C26 | Previously-enumerated Compound 22 | 0.57 |
| Example C27 | Previously-enumerated Compound 23 | 0.80 |
| Example C28 | Previously-enumerated Compound 24 | 0.78 |

*Compound 1: $CH_2$—[NHCOO—$(CH_2)_2$—$CH_3]_2$
*Compound 2: $(CH_2)_2$—[NHCOO—$(CH_2)_3$—$CH_3]_2$
*Compound 3: $(CH_2)_3$—[NHCOO—$(CH_2)_2$—$CH_3]_2$
*Compound 4: $CH_2$—[NHCOO—$(CH_2)_3$—$CH_3]_2$

Heat Transfer Recording Test

The heat transfer sheets obtained in Examples C1 to C28 were respectively superposed on the above-prepared heat transfer image-receiving sheet so that the dye-transfer promoting layer faced the dye-receiving layer. Thermal energy was then applied to the back surface of the heat transfer sheet by using a thermal head (KMT-85-6, MPD 2) to conduct thermal head recording under the following conditions:

| | |
|---|---|
| Electric voltage applied: | 12.0 V |
| Pulse width applied: | step pattern method was applied, reduced stepwise from 16.0 msec/line at every 1 msec |
| Density in sub-scanning direction: | 6 line/mm (33.3 msec/line) |

Thereafter, the dye layer was superposed on the dye-transfer promoting layer transferred on the dye-receiving layer, and thermal head recording was conducted under the same conditions as the above.

The results are shown in below Table C2. It is noted that Comparative Example C1 shown in the table is an example in which heat transfer recording was conducted by directly transferring the dye without transferring the dye-transfer promoting layer in advance.

TABLE C2

| Heat transfer sheet | Relative Sensitivity |
|---|---|
| Example C1 | 1.8 |
| Example C2 | 1.6 |
| Example C3 | 1.5 |
| Example C4 | 1.7 |

TABLE C2-continued

| Heat transfer sheet | Relative Sensitivity |
|---|---|
| Example C5 | 1.8 |
| Example C6 | 1.6 |
| Example C7 | 1.5 |
| Example C8 | 1.9 |
| Example C9 | 1.8 |
| Example C10 | 1.8 |
| Example C11 | 1.5 |
| Example C12 | 1.9 |
| Example C13 | 1.8 |
| Example C14 | 1.8 |
| Example C15 | 1.8 |
| Example C16 | 1.7 |
| Example C17 | 1.7 |
| Example C18 | 1.8 |
| Example C19 | 1.6 |
| Example C20 | 1.8 |
| Example C21 | 1.5 |
| Example C22 | 1.5 |
| Example C23 | 1.7 |
| Example C24 | 1.7 |
| Example C25 | 1.8 |
| Example C27 | 1.6 |
| Example C28 | 1.7 |
| Comp. Exam. C1 | 1.0 |

The relative sensitivities were determined as follows: The density of the image obtained in Comparative Example C1 was measured and indicated by 1.0, and those of the other images were respectively measured and indicated by relative values thereto.

It can thus be known that according to the above present invention, a heat transfer sheet which can produce an image having a 50% or more improved density with application of printing energy in the same amount as required in the conventional recording methods is obtainable by providing a dye-transfer promoting layer on a substrate film, next to a dye layer.

EXAMPLES D1 TO D24 AND COMPARATIVE EXAMPLE D1

A coating liquid for forming a dye-receiving layer, having the following formulation, was coated onto one surface of a substrate film, synthetic paper ("Yupo FPG 150") manufactured by Oji-Yuka Synthetic Paper Co., Ltd.), in an amount of 4.5 g/m² on dry basis, and then dried at 100° C. for 30 minutes to form a dye-receiving layer.

| Coating Liquid for Forming Dye-Receiving Layer | |
|---|---|
| Polyester resin ("Vylon 200" manufactured by Toyobo Co., Ltd.) | 11.5 parts |
| Vinyl chloride - vinyl acetate copolymer ("VYHH" manufactured by Union Carbide Corp.) | 5.0 parts |
| Amino-modified silicone oil ("KF 393" manufactured by Shin-Etsu Chemical Co., Ltd.) | 1.2 parts |
| Epoxy-modified silicone oil ("X-22-343" manufactured by Shin-Etsu Chemical Co., Ltd.) | 1.2 parts |
| Methyl ethyl ketone | 40.8 parts |
| Toluene | 40 8 parts |
| Cyclohexanone | 20.4 parts |

Thereafter, a 5% ethyl alcohol solution of the compound having a low melting point shown in Table D1 was coated onto the surface of the above-formed dye-receiving layer by a gravure coater, and then dried to form a dye-transfer promoting layer. The coating amount (g/m²) of the solution on solid basis is shown in Table D1. Heat transfer image-receiving sheets according to the present invention and a comparative heat transfer image-receiving sheet were thus obtained as continuous films.

COMPARATIVE EXAMPLE D2

The procedure in Example D1 was repeated except that 10 parts of the previously-enumerated Compound 1 was further added to the coating liquid for forming the dye-receiving layer employed in Example D1, and, instead, the dye-transfer promoting layer formed in Example D1 was not formed, whereby a comparative heat transfer image-receiving sheet was obtained.

Preparation of Heat Transfer Recording Sheet

An ink composition for forming a dye layer, having the following formulation, was coated onto the surface of a substrate film, a polyethyleneterephthalate film 6 μm thick with its back surface imparted with heat resistance, in an amount of 1.0 g/m$^2$ on dry basis by means of gravure printing, and then dried to form a dye layer. A heat transfer sheet for use with the heat transfer image-receiving sheets according to the present invention and the comparative ones was thus obtained.

| Ink Composition for Forming Dye Layer | |
|---|---|
| C.I. Solvent Blue 63 ("Kayaset Blue 714" manufactured by Nippon Kayaku Co., Ltd.) | 5.50 parts |
| Polyvinyl butyral resin ("S-Lec BX-1" manufactured by Sekisui Chemical Co., Ltd.) | 3.00 parts |
| Methyl ethyl ketone | 22.54 parts |
| Toluene | 68.18 parts |

TABLE D1

| | Compound having a low melting point | Coating amount g/m$^2$ |
|---|---|---|
| Example D1 | Previously-enumerated Compound 1 | 0.31 |
| Example D2 | Previously-enumerated Compound 2 | 0.29 |
| Example D3 | Previously-enumerated Compound 3 | 0.33 |
| Example D4 | Previously-enumerated Compound 4 | 0.37 |
| Example D5 | Previously-enumerated Compound 5 | 0.28 |
| Example D6 | Previously-enumerated Compound 6 | 0.25 |
| Example D7 | Previously-enumerated Compound 7 | 0.29 |
| Example D8 | Previously-enumerated Compound 8 | 0.32 |
| Example D9 | Previously-enumerated Compound 9 | 0.34 |
| Example D10 | Previously-enumerated Compound 10 | 0.31 |
| Example D11 | Previously-enumerated Compound 11 | 0.27 |
| Example D12 | Previously-enumerated Compound 12 | 0.33 |
| Example D13 | Previously-enumerated Compound 13 | 0.29 |
| Example D14 | Previously-enumerated Compound 14 | 0.30 |
| Example D15 | Previously-enumerated Compound 15 | 0.32 |
| Example D16 | Previously-enumerated Compound 16 | 0.34 |
| Example D17 | Previously-enumerated Compound 17 | 0.27 |
| Example D18 | Previously-enumerated Compound 18 | 0.31 |

TABLE D1-continued

| | Compound having a low melting point | Coating amount g/m$^2$ |
|---|---|---|
| Example D19 | Previously-enumerated Compound 19 | 0.29 |
| Example D20 | Previously-enumerated Compound 20 | 0.33 |
| Example D21 | Previously-enumerated Compound 21 | 0.25 |
| Example D22 | Previously-enumerated Compound 22 | 0.30 |
| Example D23 | Previously-enumerated Compound 23 | 0.27 |
| Example D24 | Previously-enumerated Compound 24 | 0.28 |
| Comp. Exam. D1 | Not used | — |
| Comp. Exam. D2 | Previously-enumerated Compound 1 | Internal addition |

Heat Transfer Recording Test

The heat transfer image-receiving sheets obtained in Examples D1 to D24 and Comparative Examples D1 and D2 were respectively superposed on the above-prepared heat transfer sheet so that the dye-receiving layer faced the dye layer. Thermal energy was then applied to the back surface of the heat transfer sheet by using a thermal head (KMT-85-6, MPD 2) to conduct thermal head recording under the following conditions:

| | |
|---|---|
| Electric voltage applied: | 12.0 V |
| Pulse width applied: | step pattern method was applied, reduced stepwise from 16.0 msec/line at every 1 msec |
| Density in sub-scanning direction: | 6 line/mm (33.3 msec/line) |

The results are shown in below Table D2.

TABLE D2

| Printing Image | Relative Sensitivity | Preservability |
|---|---|---|
| Example D1 | 1.32 | good |
| Example D2 | 1.41 | good |
| Example D3 | 1.71 | good |
| Example D4 | 1.68 | good |
| Example D5 | 1.39 | good |
| Example D6 | 1.45 | good |
| Example D7 | 1.45 | good |
| Example D8 | 1.45 | good |
| Example D9 | 1.45 | good |
| Example D10 | 1.45 | good |
| Example D11 | 1.52 | good |
| Example D12 | 1.46 | good |
| Example D13 | 1.51 | good |
| Example D14 | 1.46 | good |
| Example D15 | 1.42 | good |
| Example D16 | 1.45 | good |
| Example D17 | 1.61 | good |
| Example D18 | 1.47 | good |
| Example D19 | 1.48 | good |
| Example D20 | 1.61 | good |
| Example D21 | 1.51 | good |
| Example D22 | 1.41 | good |
| Example D23 | 1.48 | good |
| Example D24 | 1.45 | good |
| Comp. Exam. D1 | 1.00 | good |
| Comp. Exam. D2 | 1.50 | blurred |

Note (1) Relative sensitivity: The density of the image printed by using the heat transfer image-receiving sheet obtained in Comparative Example D1 was measured and indicated by 1.00, and those of the images printed by using the other image-receiving sheets were respectively measured and indicated by relative values thereto.

(2) Preservability: The heat transfer image-receiving sheets in which an image was produced under the above conditions were allowed to stand at 60° C. for 200 hours. Thereafter, the degree of diffusion of dots in the respective image was visually observed.

It can thus be known that according to the above present invention, a heat transfer image-receiving sheet which can produce an image having a 30% or more improved density with application of printing energy in the same amount as required in the conventional recording methods, and can well preserve the image produced therein is obtainable by providing a dye-transfer promoting layer on a dye-receiving layer.

EXAMPLE E1

A coating liquid having the following formulation was coated onto one surface of a substrate sheet, synthetic paper ("Yupo FRG-150") manufactured by Oji-Yuka Synthetic Paper Co., Ltd., in 150 μm thick) in an amount of 10.0 g/m$^2$ on dry basis by a bar coater, and roughly dried by a dryer, then in an oven at 120° C. for 10 minutes to form a dye-receiving layer with a releasing layer concurrently formed on the dye-receiving layer. A heat transfer image-receiving sheet according to the present invention was thus obtained.

| Formulation of Coating Liquid | |
|---|---|
| Urethane-modified polyester resin (Nitrogen content 1.7%)*1 | 100 parts |
| Compound having a low melting point (Previously-enumerated Compound 1) | 30 parts |
| Catalyst-setting-type silicone ("X-62-1212" manufactured by Shin-Etsu Chemical Co., Ltd.) | 10 parts |
| Catalyst for reaction ("PL 50 T" manufactured by Shin-Etsu Chemical Co., Ltd.) | 1 part |
| Methyl ethyl ketone/toluene (weight ratio 1:1) | 400 parts |

Note
*1: A resin having a molecular weight of 18,000, obtained by modifying polyester diol having a molecular weight of 2,000, prepared by using dimethylterephthalic acid, dimethylisophthalic acid, trimellitic anhydride, tricyclodecan dimethylol and neopentyl glycol, with hexamethylene diisocyanate and neopentyl glycol.

EXAMPLE E2

The procedure in Example E1 was repeated except that the coating liquid employed in Example E1 was replaced by a coating liquid having the following formulation, whereby a heat transfer image-receiving sheet according to the present invention was obtained.

| Formulation of Coating Liquid | |
|---|---|
| Urethane-modified polyester resin (Nitrogen content 1.3%)*2 | 100 parts |
| Compound having a low melting point (Previously-enumerated Compound 2) | 25 parts |
| Catalyst-setting-type silicone ("X-62-1212" manufactured by Shin-Etsu Chemical Co., Ltd.) | 6 parts |
| Catalyst for reaction ("PL 50 T" manufactured by Shin-Etsu Chemical Co., Ltd.) | 0.3 parts |
| Methyl ethyl ketone/toluene (weight ratio 1:1) | 400 parts |

Note
*2: A resin having a molecular weight of 32,000, prepared by using dimethylterephthalic acid, dimethylisophthalic acid, trimellitic anhydride, 2-ethyl-2-butyl-1,3propandiol, polyester diol obtained from neopentyl glycol, "Macromonomer HA-6" manufactured by Toa Gosei Chemical Industry Co., Ltd., and hexamethylene diisocyanate.

EXAMPLES E3 TO E7

The procedure in Example E1 was repeated except that the compound having a low melting point used in Example E1 as a sensitizing agent was replaced by a compound shown in the below Table E1, whereby heat transfer image-receiving sheets according to the present invention were respectively obtained.

TABLE E1

| Example | Compound having a low melting point |
|---|---|
| E3 | Previously-enumerated Compound 3 |
| E4 | Previously-enumerated Compound 12 |
| E5 | Previously enumerated Compound 15 |
| E6 | Previously-enumerated Compound 13 |
| E7 | Previously-enumerated Compound 4 |

COMPARATIVE EXAMPLE E1

The procedure in Example E1 was repeated except that the coating liquid employed in Example E1 was replaced by a coating liquid having the following formulation, whereby a comparative heat transfer image-receiving sheet was obtained.

| Formulation of Coating Liquid | |
|---|---|
| Polyester resin ("Vylon 200" manufactured by Toyobo Co., Ltd.) | 100 parts |
| Epoxy-modified silicone ("X-22-3000C" manufactured by Shin-Etsu Chemical Co., Ltd.) | 9 parts |
| Amino-modified silicone ("X-22-3050C" manufactured by Shin-Etsu Chemical Co., Ltd.) | 9 parts |
| Methyl ethyl ketone/toluene (weight ratio 1:1) | 400 parts |

COMPARATIVE EXAMPLE E2

The procedure in Comparative Example E1 was repeated except that 30 parts of the previously-enumerated Compound 1 was further added to the coating liquid employed in Comparative Example E1, whereby a comparative heat transfer image-receiving sheet was obtained.

COMPARATIVE EXAMPLE E3

The procedure in Comparative Example E2 was repeated except that the polyester resin in the coating liquid employed in Comparative Example E2 was replaced by 100 parts of a polyurethane resin (nitrogen content 8.5%), whereby a comparative heat transfer image-receiving sheet was obtained.

COMPARATIVE EXAMPLE E4

The procedure in Example E1 was repeated except that the releasing agent employed in Example E1 was replaced by the following releasing agents, whereby a comparative heat transfer image-receiving sheet was obtained.

| | |
|---|---|
| Epoxy-modified silicone ("X-22-3000C" manufactured by Shin-Etsu Chemical Co., Ltd.) | 7 parts |
| Amino-modified silicone ("X-22-3050C" manufactured by Shin-Etsu Chemical Co., Ltd.) | 7 parts |

COMPARATIVE EXAMPLE E5

The procedure in Comparative Example E1 was repeated except that the releasing agents employed in Comparative Example E1 were replaced by the following releasing agents, whereby a comparative heat transfer image-receiving sheet was obtained.

| | |
|---|---|
| Catalyst-crosslinking-type silicone ("X-62-1212" manufactured by Shin-Etsu Chemical Co., Ltd.) | 6 parts |
| Catalyst for reaction ("PL 50 T" manufactured by Shin-Etsu Chemical Co., Ltd.) | 0.3 parts |

Preparation of Heat Transfer Sheet

A coating liquid for forming a dye layer, having the following formulation, was coated onto the surface of a substrate film, a polyethyleneterephthalate film 4.5 μm thick with its back surface imparted with heat resistance, in an amount of 1.0 g/m$^2$ on dry basis by a wire bar, and then dried to form a dye layer. Thereafter, several droplets of a silicone oil, "X-41.4003A" manufactured by Shin-Etsu Chemical Co., Ltd., were dropped on the back surface of the substrate film by using a syringe, and then spread thereover. Thus, a heat transfer sheet with its back surface coated was obtained.

| Coating Liquid for Forming Dye Layer | |
|---|---|
| Disperse dye ("Kayaset Blue 714" manufactured by Nippon Kayaku Co., Ltd.) | 7 parts |
| Polyvinyl butyral resin ("BX-1" manufactured by Sekisui Chemical Co., Ltd.) | 35 parts |
| Methyl ethyl ketone/toluene (weight ratio 1:1) | 90 parts |

Heat Transfer Recording Test

The heat transfer image-receiving sheets according to the present invention obtained in Examples E1 to E7 and the comparative image-receiving sheets obtained in Comparative Examples E1 to E5 were respectively superposed on the above-prepared heat transfer sheet so that the dye-receiving layer faced the dye layer. Heat transfer recording was conducted by using a thermal head under the following conditions:

Output power: 1 W/dot
Pulse width: 0.3 to 0.45 msec
Dot density: 6 dots/mm

After producing a cyan image, the properties of the heat transfer image-receiving sheets were evaluated. The results are shown in below Table E2.

TABLE E2

| | Printing sensitivity | Releasability | Preservability of image-receiving sheet: Change in surface gloss | Preservability of image-receiving sheet: Blur of printed image | Quality of image printed |
|---|---|---|---|---|---|
| Ex. E1 | 1.85 | ◎ | ○ | ◎ | ◎ |
| Ex. E2 | 1.73 | ◎ | ◎ | ◎ | ◎ |
| Ex. E3 | 1.23 | ◎ | ◎ | ◎ | ◎ |
| Ex. E4 | 1.90 | ◎ | ◎ | ◎ | ◎ |
| Ex. E5 | 1.32 | ◎ | ○ | ◎ | ○ |
| Ex. E6 | 1.49 | ◎ | ◎ | ◎ | ◎ |
| Ex. E7 | 1.78 | ◎ | ◎ | ◎ | ◎ |
| Comp. Ex. E1 | 1.00 | ○ | X | X | ◎ |
| Comp. Ex. E2 | 1.65 | ○ | X | X | X |
| Comp. Ex. E3 | 1.59 | Δ | X | X | X |
| Comp. Ex. E4 | 1.80 | ○ | X | X | ◎ |
| Comp. Ex. E5 | 0.90 | ○ | ◎ | ◎ | X |

Evaluation

Printing sensitivity: The reflection density of the image printed by using the heat transfer image-receiving sheet obtained in Comparative Example E1 was indicated by 1.00, and the reflection densities of the other images were indicated by relative values thereto.

Releasability: The heat transfer sheet was peeled off the image-receiving sheet by hand after the completion of recording, and releasability was evaluated in accordance with the following standards:

◎: Released very easily
○: Released easily
Δ: Slightly adhered to each other
x: Adhered to each other, and the dye layer was separated from the substrate film Preservability of Heat Transfer Image-Receiving Sheet (1) Change in surface gloss: The image-receiving sheet was placed at a temperature of 60° C. and a relative humidity of 60% for 200 hours, and change in its surface gloss was visually observed.

◎: No change
○: Almost no change
x: Remarkably changed (2) Blur in printed image: The image-receiving sheet bearing a printed image was placed at a temperature of 60° C. in a dried atmosphere for 200 hours, and dots in the image were microscopically observed as to whether or not they were blurred.

◎: No blur
○: Almost no blur
x: Blurred

Quality of Image Printed: The printed image was observed by a microscope, and the quality thereof was evaluated in terms of resolution and voids.

◎: Excellent
○: Good
x: Poor

It can thus be known that according to the above present invention, a heat transfer image-receiving sheet which is excellent in releasability, printing sensitivity and preservability is obtainable, by incorporating a catalyst-setting-type releasing agent containing an unsaturated bond into a dye-receiving layer which comprises a specific resin and a compound having a low melting point (sensitizing agent).

REFERENTIAL EXAMPLES F1 TO F28

Preparation of Heat-Transferable Dye-Transfer Promoting Agent Sheet

A 5% ethyl alcohol solution of the compound having a low melting point shown in below Table F1 was coated onto the surface of a substrate film, a polyethyleneterephthalate film having a thickness of 6 μm, by a gravure coater, and then dried to form a dye-transfer promoting layer. The coating amount (g/m$^2$) of the solution on solid basis is shown in the table. Thus, heat-transferable dye-transfer promoting agent sheets according to the present invention were respectively obtained as continuous films.

TABLE F1

| | Compound having a low melting point | Coating amount g/m$^2$ |
|---|---|---|
| Example F1 | Below-described Compound 1* | 0.97 |
| Example F2 | Below-described Compound 2* | 1.03 |
| Example F3 | Below-described Compound 3* | 0.89 |
| Example F4 | Below-described Compound 4* | 0.78 |
| Example F5 | Previously-enumerated Compound 1 | 0.62 |
| Example F6 | Previously-enumerated Compound 2 | 0.55 |
| Example F7 | Previously-enumerated Compound 3 | 0.48 |
| Example F8 | Previously-enumerated Compound 4 | 0.81 |
| Example F9 | Previously-enumerated Compound 5 | 0.79 |
| Example F10 | Previously-enumerated Compound 6 | 0.73 |
| Example F11 | Previously-enumerated Compound 7 | 0.64 |
| Example F12 | Previously-enumerated Compound 8 | 0.85 |
| Example F13 | Previously-enumerated Compound 9 | 0.83 |
| Example F14 | Previously-enumerated Compound 10 | 0.77 |
| Example F15 | Previously-enumerated Compound 11 | 0.62 |
| Example F16 | Previously-enumerated Compound 12 | 0.84 |
| Example F17 | Previously-enumerated Compound 13 | 0.74 |
| Example F18 | Previously-enumerated Compound 14 | 0.56 |
| Example F19 | Previously-enumerated Compound 15 | 0.96 |
| Example F20 | Previously-enumerated Compound 16 | 0.57 |
| Example F21 | Previously-enumerated Compound 17 | 0.87 |
| Example F22 | Previously-enumerated Compound 18 | 0.69 |
| Example F23 | Previously-enumerated Compound 19 | 0.75 |
| Example F24 | Previously-enumerated Compound 20 | 0.82 |
| Example F25 | Previously-enumerated Compound 21 | 0.96 |
| Example F26 | Previously-enumerated Compound 22 | 0.87 |
| Example F27 | Previously-enumerated Compound 23 | 0.67 |
| Example F28 | Previously-enumerated Compound 24 | 0.83 |

*Compound 1: $CH_2$—[NHCOO—$(CH_2)_2$—$CH_3]_2$
*Compound 2: $(CH_2)_2$—[NHCOO—$(CH_2)_3$—$CH_3]_2$
*Compound 3: $(CH_2)_3$—[NHCOO—$(CH_2)_2$—$CH_3]_2$
*Compound 4: $CH_2$—[NHCOO—$(CH_2)_3$—$CH_3]_2$

Preparation of Heat Transfer Sheet

An ink composition for forming a dye layer, having the following formulation, was coated onto the surface of a substrate film, a polyethyleneterephthalate film 6 μm thick with its back surface imparted with heat resistance, in an amount of 1.0 g/m$^2$ on dry basis by means of gravure printing, and then dried to form a dye layer, whereby a heat transfer sheet was obtained.

| Ink Composition for Forming Dye Layer | |
|---|---|
| C.I. Solvent Blue 63 ("Kayaset Blue 714" manufactured by Nippon Kayaku Co., Ltd.) | 5.50 parts |
| Polyvinyl butyral resin ("S-Lec BX-1" manufactured by Sekisui Chemical Co., Ltd.) | 3.00 parts |
| Methyl ethyl ketone | 22.54 parts |
| Toluene | 68.18 parts |

Preparation of Heat Transfer Image-Receiving Sheet

A coating liquid having the following formulation was coated onto one surface of a substrate film, synthetic paper ("Yugo FPG 150" manufactured by Oji-Yuka Synthetic Paper Co., Ltd.), in an amount of 4.5 g/m$^2$ on dry basis, and then dried at 100° C. for 30 minutes to form a dye-receiving layer, whereby a heat transfer image-receiving sheet was obtained.

| Coating Liquid for Forming Dye-Receiving Layer | |
|---|---|
| Polyester resin ("Vylon 200" manufactured by Toyobo Co., Ltd.) | 11.5 parts |
| Vinyl chloride - vinyl acetate copolymer ("VYHH" manufactured by Union Carbide Corp.) | 5.0 parts |
| Amino-modified silicone oil ("KF393" manufactured by Shin-Etsu Chemical Co., Ltd.) | 1.2 parts |
| Epoxy-modified silicone oil ("X-22-343" manufactured by Shin-Etsu Chemical Co., Ltd.) | 1.2 parts |
| Methyl ethyl ketone | 40.8 parts |
| Toluene | 40.8 parts |
| Cyclohexanone | 20.4 parts |

EXAMPLES F1 TO F5

Each of the heat-transferable dye-transfer promoting agent sheets obtained in Referential Examples F1 to F5, shown in Table F1, and the above-prepared heat transfer sheet and image-receiving sheet were placed in a printer as shown in FIG. 4. Then, at first, the heat-transferable dye-transfer promoting agent sheet was superposed on the image-receiving sheet so that the dye-transfer promoting layer faced the dye-receiving layer, and the back surface of the promoting agent sheet was heated by a 120° C. heat roller, thereby transferring the dye-transfer promoting layer to the entire surface of the dye-receiving layer. Subsequently, thermal head recording was conducted by using a thermal head (KMT-85-6, MPD 2) under the following conditions, whereby the dye layer of the heat transfer sheet was transferred to the dye-transfer promoting layer:

| | |
|---|---|
| Voltage applied: | 12.0 V |
| Pulse width applied: | step pattern method was applied, reduced stepwise from 16.0 msec/line at every 1 msec |
| Density in sub-scanning direction: | 6 line/mm (33.3 msec/line) |

The results are shown in below Table F2. It is noted that Comparative Example F1 shown in the table is an example in which heat transfer recording was conducted by directly transferring the dye without transferring the dye-transfer promoting layer in advance.

EXAMPLES F6 TO F10

The procedure in Example F1 was repeated except that the heat-transferable dye-transfer promoting agent sheet employed in Example F1 was replaced by each of the promoting agent sheets obtained in Referential Examples F6 to F10, and the printer used in Example F1 was replaced by a printer shown in FIG. 5. The results are shown in Table F2.

REFERENTIAL EXAMPLES F11 TO F14

An ink composition for forming a dye layer, having the following formulation, was coated onto the surface of a substrate film, a polyethyleneterephthalate film 6 μm thick with its back surface imparted with heat resistance, in an amount of 1.0 g/m$^2$ on dry basis, in a width of 30 cm, by means of gravure printing, and then dried to form a dye layer.

| Ink Composition for Forming Dye Layer | |
|---|---|
| C.I. Solvent Blue 63 ("Kayaset Blue 714" manufactured by Nippon Kayaku Co., Ltd.) | 5.50 parts |
| Polyvinyl butyral resin ("S-Lec BX-1" manufactured by Sekisui Chemical Co., Ltd.) | 3.00 parts |
| Methyl ethyl ketone | 22.54 parts |
| Toluene | 68.18 parts |

Thereafter, a 5% ethyl alcohol solution of the compound having a low melting point shown in Table F1 was coated onto the surface of the substrate film, next to the above dye layer, in a width of 3 cm, by a gravure coater, and then dried to form a dye-transfer promoting layer. The coating amount (g/m$^2$) of the solution on solid basis is shown in the table. Heat transfer sheets were thus obtained as continuous films.

EXAMPLES F11 TO F28

The heat transfer recording sheets obtained in Referential Examples F11 to F28 were respectively superposed on the previously-obtained heat transfer image-receiving sheet so that the dye-transfer promoting layer faced the dye-receiving layer. Thermal energy was then applied to the back surface of the heat transfer recording sheet by a thermal head (KMT-85-6, MPD 2) under the following conditions to conduct thermal head recording:

| | |
|---|---|
| Voltage applied: | 12.0 V |
| Pulse width applied: | step pattern method was applied, reduced stepwise from 16.0 msec/line at every 1 msec |
| Density in sub-scanning direction: | 6 line/mm (33.3 msec/line) |

Subsequently, the dye layer was superposed on the dye-transfer promoting layer, and thermal head recording was conducted under the same conditions as in the above. The results are shown in below Table F2.

TABLE F2

| Heat transfer sheet | Relative Sensitivity |
|---|---|
| Example F1 | 1.8 |
| Example F2 | 1.6 |
| Example F3 | 1.5 |
| Example F4 | 1.7 |
| Example F5 | 1.8 |
| Example F6 | 1.6 |

TABLE F2-continued

| Heat transfer sheet | Relative Sensitivity |
|---|---|
| Example F7 | 1.5 |
| Example F8 | 1.9 |
| Example F9 | 1.8 |
| Example F10 | 1.8 |
| Example F11 | 1.5 |
| Example F12 | 1.9 |
| Example F13 | 1.8 |
| Example F14 | 1.8 |
| Example F15 | 1.8 |
| Example F16 | 1.7 |
| Example F17 | 1.7 |
| Example F18 | 1.8 |
| Example F19 | 1.6 |
| Example F20 | 1.8 |
| Example F21 | 1.5 |
| Example F22 | 1.5 |
| Example F23 | 1.7 |
| Example F24 | 1.7 |
| Example F25 | 1.8 |
| Example F26 | 1.7 |
| Example F27 | 1.6 |
| Example F28 | 1.7 |
| Comp. Exam. F1 | 1.0 |

The relative sensitivities were determined as follows: The density of the image obtained in Comparative Example F1 was measured and indicated by 1.0, and the densities of the other images were measured and indicated by relative values thereto.

It can thus be known that according to the above present invention, an image having a 50% or more improved density can be obtained with application of thermal energy in the same amount as that of printing energy required in the conventional recording methods, by giving a dye-transfer promoting agent to a dye layer and/or a dye-receiving layer when conducting heat transfer recording.

What is claimed is:

1. A heat transfer sheet comprising:

a substrate film, a dye layer formed on said substrate film, comprising a dye and a binder, and a dye-transfer promoting layer formed on the dye layer said dye transfer promoting layer comprising a compound which is in a crystalline state at room temperature and can be fused by thermal energy which is applied when heat transfer is conducted, said dye-transfer promoting layer comprising a bis compound having the following formula (I):

$$A-[B-X-Y-Z]_2 \quad (I)$$

wherein

A is selected from the group consisting of

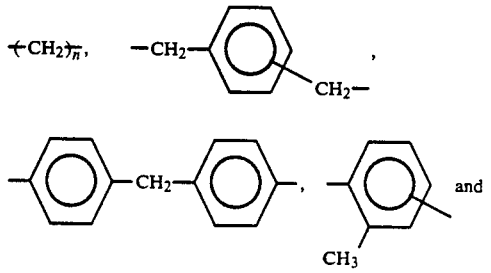

-continued

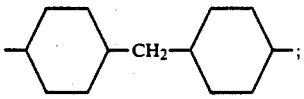

n is an integer of 1 or more;

B is selected from the group consisting of —NH-COO—, —NHCONR—, CONH— and —NH-CO—;

R is a linear or branched $C_1$-$C_6$ alkyl group which may have a substituent;

X is a linear or branched alkylene group which may have a substituent;

Y is a single bond, or a bonding group selected from the group consisting of —O—, —S—, —COO—, —NHCOO—, —OOCHN—, —CONH—, —NH-CO—, —$SO_2$NH—, —NH$SO_2$—, —$SO_2$— and —$O_2$S—; and Z is a hydrogen atom, a linear or branched alkyl group which may have a substituent and/or an unsaturated group, or a phenyl group.

2. A heat transfer sheet according to claim 1, wherein said dye-transfer promoting layer has a thickness of from 0.01 to 1.0 g/$m^2$.

3. The heat transfer sheet according to claim 1, wherein said bis compound has a melting point of 50°-150° C.

4. The heat transfer sheet according to claim 1, wherein said bis compound has a molecular weight of 100-1,500.

5. A heat transfer sheet comprising:

a dye layer formed on the substrate film, comprising a dye and a binder, and a dye-transfer promoting layer formed on the substrate film, next to the dye layer, comprising a compound which is in a crystalline state at room temperature and can be fused by thermal energy which is applied when heat transfer recording is conducted, said dye-transfer promoting layer comprising a bis compound having the following formula:

$$A—[B—X—Y—Z]_2 \quad (I)$$

wherein

A is selected from the group consisting of

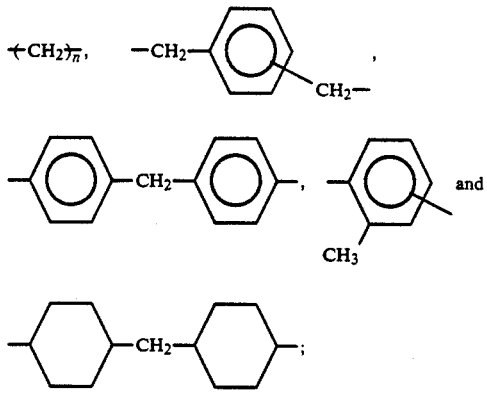

n is an integer of 1 or more;

B is selected from the group consisting of —NH-COO—, —NHCONR—, CONH— and —NH-CO—;

R is a linear or branched $C_1$-$C_6$ alkyl group which may have a substituent;

X is a linear or branched alkylene group which may have a substituent;

Y is a single bond, or a bonding group selected from the group consisting of —O—, —S—, —COO—, —OOC—, —NHCOO—, —OOCHN—, —CONH—, —NHCO—, —$SO_2$NH—, —NH-$SO_2$—, —$SO_2$— and —$O_2$S—; and Z is a hydrogen atom, a linear or branched alkyl group which may have a substituent and/or an unsaturated group, or a phenyl group.

6. A heat transfer sheet according to claim 5, wherein said dye-transfer promoting layer has a thickness of from 0.01 g/$m^2$.

7. The heat transfer sheet according to claim 5, wherein said bis compound has a melting point of 50°-150° C.

8. The heat transfer sheet according to claim 5, wherein said bis compound has a molecular weight of 100-1,500.

* * * * *